US005613481A

United States Patent [19]

Kitagawa et al.

[11] Patent Number: 5,613,481

[45] Date of Patent: Mar. 25, 1997

[54] CONTROL SYSTEM HAVING FUNCTION OF PROCESSING EVAPORATIVE FUEL FOR INTERNAL COMBUSTION ENGINES

[75] Inventors: Hiroshi Kitagawa; Shusuke Akazaki; Hidetaka Maki, all of Wako, Japan

[73] Assignee: Honda Giken Kogyo Kabushiki Kaisha, Tokyo, Japan

[21] Appl. No.: 606,077

[22] Filed: Feb. 23, 1996

[30] Foreign Application Priority Data

Feb. 24, 1995 [JP] Japan ..... 7-061777

[51] Int. Cl.[6] ..... F02D 41/14

[52] U.S. Cl. ..... 123/698; 123/520

[58] Field of Search ..... 123/520, 698

[56] References Cited

U.S. PATENT DOCUMENTS 5,216,997 6/1993 Osanai et al. ..... 123/520 X
5,553,595 9/1996 Nishioka et al. ..... 123/698

FOREIGN PATENT DOCUMENTS 3-185244 8/1991 Japan .

OTHER PUBLICATIONS

"Computrol", Corona Publishing Co., Ltd., Japan, No. 27, 1989, pp. 28–41.

"Automatic Control Handbook", Ohm, Ltd., 1983, pp. 703–707.

"A Survey of Model Reference Adaptive Techniques—Theory and Applications", Landau, *Automatica,* vol. 10, 1974, pp. 353–379.

"Unification of Discrete Time Explicit Model Reference Adaptive Control Designs", Landau et al, *Automatica,* vol. 17, No. 4, 1981, pp. 593–611.

"Combining Model Reference Adaptive Controllers and Stochastic Self-tuning Regulators", Landau, *Automatica,* vol. 18, No. 1, 1982, pp. 77–84.

*Primary Examiner*—Tony M. Argenbright

*Attorney, Agent, or Firm*—Nikaido, Marmelstein, Murray & Oram LLP

[57] ABSTRACT

A control system for an internal combustion engine includes a canister for adsorbing evaporative fuel generated in the fuel tank, a purging passage extending between the canister and the intake system, for purging evaporative fuel into the intake system, and a purge control valve for controlling a flow rate of evaporative fuel to be supplied to the intake system through the purging passage. Various sensors detect operating conditions of the engine, and an ECU controls the purge control valve according to detected operating conditions. An amount of fuel to be supplied to the engine is feedback-controlled by calculating a feedback control amount, based on an output from an air-fuel ratio sensor arranged in the exhaust system by using a controller of a recurrence formula type, and the amount of fuel to be supplied to the engine is controlled based on the calculated feedback control amount, such that an air-fuel ratio of an air-fuel mixture supplied to the engine is converged to a desired air-fuel ratio. An average value of the feedback control amount is calculated while the purge control valve is open. The purge control valve is controlled based on the calculated average value.

6 Claims, 26 Drawing Sheets

ECU5
ECU
IG
TW
PBA
TA
θTH
PA
LAF
O2
30
31
32
33
60
15
1
14
5
13
12
11
10
9
4
3
7
6
2
8
21
20
19
16
18
17
23
22
40
41
42
43
44

NE
PBA
θTH
PA
B1
TIMF
B2
B3
B4
B9
KTOTAL
TOUT
1
ENG
19
CAT
20
CAT
17
LAF
18
O2
22
LPF
B10
SELV
B16
LPF
B17
LPF
23
LPF
B18
PID
B19
STR
B21
KCMD
KCMD
KLAF
KSTR
KCMD
B20
SW
B22
MIDO2 FB
KCMD
KFB
B23
KCMDM
KCMDM

FIG.7A
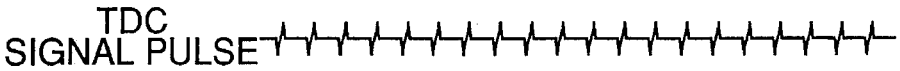
FIG.7B
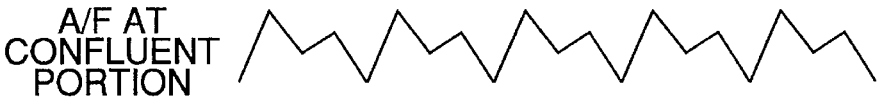
FIG.8A
FIG.8B
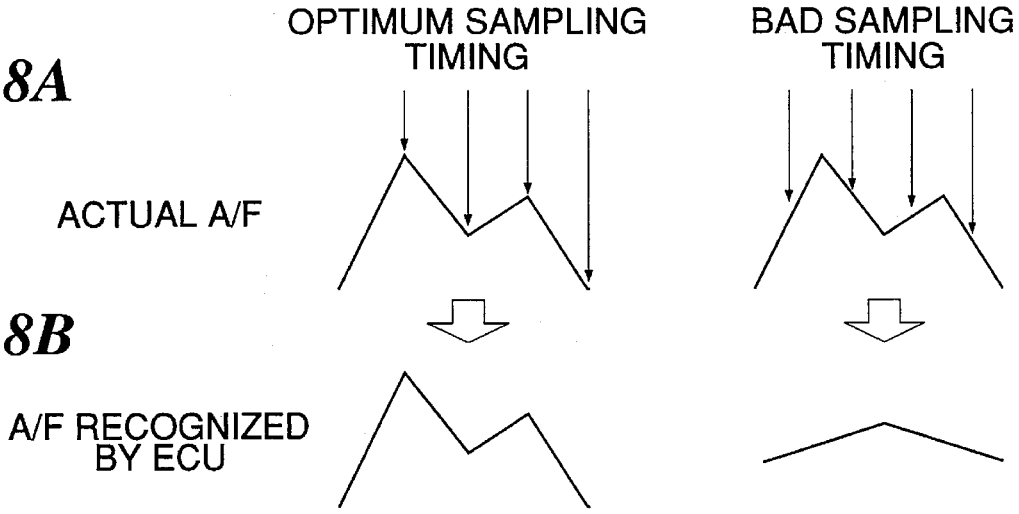

CONTROL SYSTEM HAVING FUNCTION OF PROCESSING EVAPORATIVE FUEL FOR INTERNAL COMBUSTION ENGINES

BACKGROUND OF THE INVENTION

1. Field of the Invention

This invention relate to a control system for an internal combustion engine which is provided with an evaporative emission control system for temporarily adsorbing evaporative fuel generated in the fuel tank of the engine and purging the same at suitable timing into the intake system of the engine, and more particularly to a control system of this kind, which carries out feedback control of the air-fuel ratio of an air-fuel mixture supplied to the engine by utilizing an adaptive control theory.

2. Prior Art

There is conventionally known an air-fuel ratio control system for internal combustion engines, for example, from Japanese Laid-Open Patent Publication (Kokai) No. 3-185244, in which an optimal regulator which is one of modern control theories is applied to air-fuel ratio feedback control such that the air-fuel ratio is feedback-controlled based on an output from a linear-output oxygen concentration sensor (LAF sensor) arranged in the exhaust system of the engine, and an optimum feedback gain calculated based on a dynamic model representative to the behavior of the engine.

Further, an evaporative fuel-processing system has been conventionally employed, in which evaporative fuel generated in the fuel tank is temporarily stored in a canister of the engine for purging to the intake system of the engine according to operating conditions of the engine.

According to the evaporative fuel-processing system, purging is carried out so as to exert the least possible influence upon air-fuel ratio control of an air-fuel mixture supplied to the engine. However, it is difficult to carry out purging by controlling the concentration of evaporative fuel being purged and the flow rate of a purged gas (mixture of evaporative fuel and air) with high accuracy. Further, if the air-fuel ratio is controlled by using a controller of a recurrence formula type as in the air-fuel ratio feedback control utilizing the optimal regulator, especially an adaptive controller having high deadbeat response, there is a fear that the controllability of the air-fuel ratio can be degraded when purging is carried out.

Besides, when the amount of purged fuel is large, the air-fuel ratio detected by an air-fuel ratio sensor shows a rich value, so that feedback control of the air-fuel ratio results in an extremely decreased amount of fuel injected from a fuel injection valve. Consequently, fuel injection is unfavorably carried out in a valve opening region where linearity between the valve opening period of the fuel injection valve and the fuel injection amount lowers to degrade the control accuracy of the air-fuel ratio control and hence spoil exhaust emission characteristics and drivability of the engine.

SUMMARY OF THE INVENTION

It is the object of the invention to provide a control system for internal combustion engines, which is capable of properly controlling the amount of evaporative fuel to be purged into the intake system of the engine, to thereby maintain good control accuracy of air-fuel ratio control even during execution of purging.

To attain the above object, the present invention provides a control system for an internal combustion engine having having an intake system, an exhaust system, and a fuel tank, comprising:

a canister for adsorbing evaporative fuel generated in the fuel tank;

a purging passage extending between the canister and the intake system, for purging the evaporative fuel into the intake system;

a purge control valve for controlling a flow rate of the evaporative fuel to be supplied to the intake system through the purging passage;

operating condition-detecting means for detecting operating conditions of the engine;

purge flow rate control means for controlling the purge control valve according to operating conditions detected by the operating condition-detecting means;

an air-fuel ratio sensor arranged in the exhaust system;

feedback control means for carrying out feedback control of an amount of fuel to be supplied to the engine by calculating a feedback control amount based on an output from the air-fuel ratio sensor by using a controller of a recurrence formula type, and controlling the amount of fuel to be supplied to the engine, based on the calculated feedback control amount, such that an air-fuel ratio of an air-fuel mixture supplied to the engine is converged to a desired air-fuel ratio; and control amount-averaging means for calculating an average value of the feedback control amount while the purge control valve is open;

wherein the purge flow rate control means controls the purge control valve, based on the average value calculated by the control amount-averaging means.

Preferably, the feedback control means calculates a basic fuel amount according to operating conditions of the engine detected by the operating condition detecting means and calculates an adaptive correction coefficient by using the controller of the recurrence formula type, based on the output from the air-fuel ratio sensor, to thereby determine an amount of fuel to be supplied to the engine, based on the basic fuel amount and the adaptive correction coefficient, the control amount-averaging means calculating an average value of the adaptive correction coefficient as the average value of the feedback control amount while the purge control valve is open.

Also preferably, the purge flow rate control means includes comparing means for comparing the average value of the feedback control amount with a predetermined value, the purge flow rate control means controlling the purge control valve, based on a result of the comparison by the comparing means.

More preferably, the purge flow rate control means calculates a valve-opening amount of the purge control valve, based on a basic valve opening amount depending on operating conditions of the engine detected by the operating condition-detecting means, and a correction coefficient determined depending on operating conditions of the engine detected by the operating condition-detecting means and a flow rate of evaporative fuel purged through the purging passage, the purge flow rate control means changing the correction coefficient, based on the result of the comparison of the comparing means.

Alternatively, the purge flow rate control means includes difference-calculating means for calculating a difference between the average value of the feedback control amount and a predetermined reference value, the purge flow rate control means controlling the purge control valve, based on the difference.

Preferably, the purge flow rate control means calculates a valve-opening amount of the purge control valve, based on a basic valve opening amount depending on operating conditions of the engine detected by the operating condition-detecting means, and a correction coefficient determined depending on the detected operating conditions of the engine detected by the operating condition-detecting means and a flow rate of evaporative fuel purged through the purging passage, the purge flow rate control means changing the correction coefficient, based on the difference calculated by the difference-calculating means.

The above and other objects, features, and advantages of the invention will become more apparent from the following detailed description taken in conjunction with the accompanying drawings.

BRIEF DESCRIPTION OF THE DRAWINGS

FIGS. 7A and 7B collectively form a timing chart showing the relationship between generation of TDC signal pulses of the engine and an air-fuel ratio detected at a confluent portion of the exhaust system of the engine (output from the LAF sensor), in which:

FIG. 7A shows TDC signal pulses; and

FIG. 7B shows the output from the LAF sensor;

FIGS. 8A and 8B show good and bad examples of timing of sampling output from the LAF sensor, in which:

FIG. 8A shows examples of sampling timing in relation to the actual air-fuel ratio; and FIG. 8B shows examples of the air-fuel ratio recognized by an ECU through sampling of the output from the LAF sensor;

DETAILED DESCRIPTION

The invention will now be described in detail with reference to drawings showing embodiments thereof.

Figure 1:
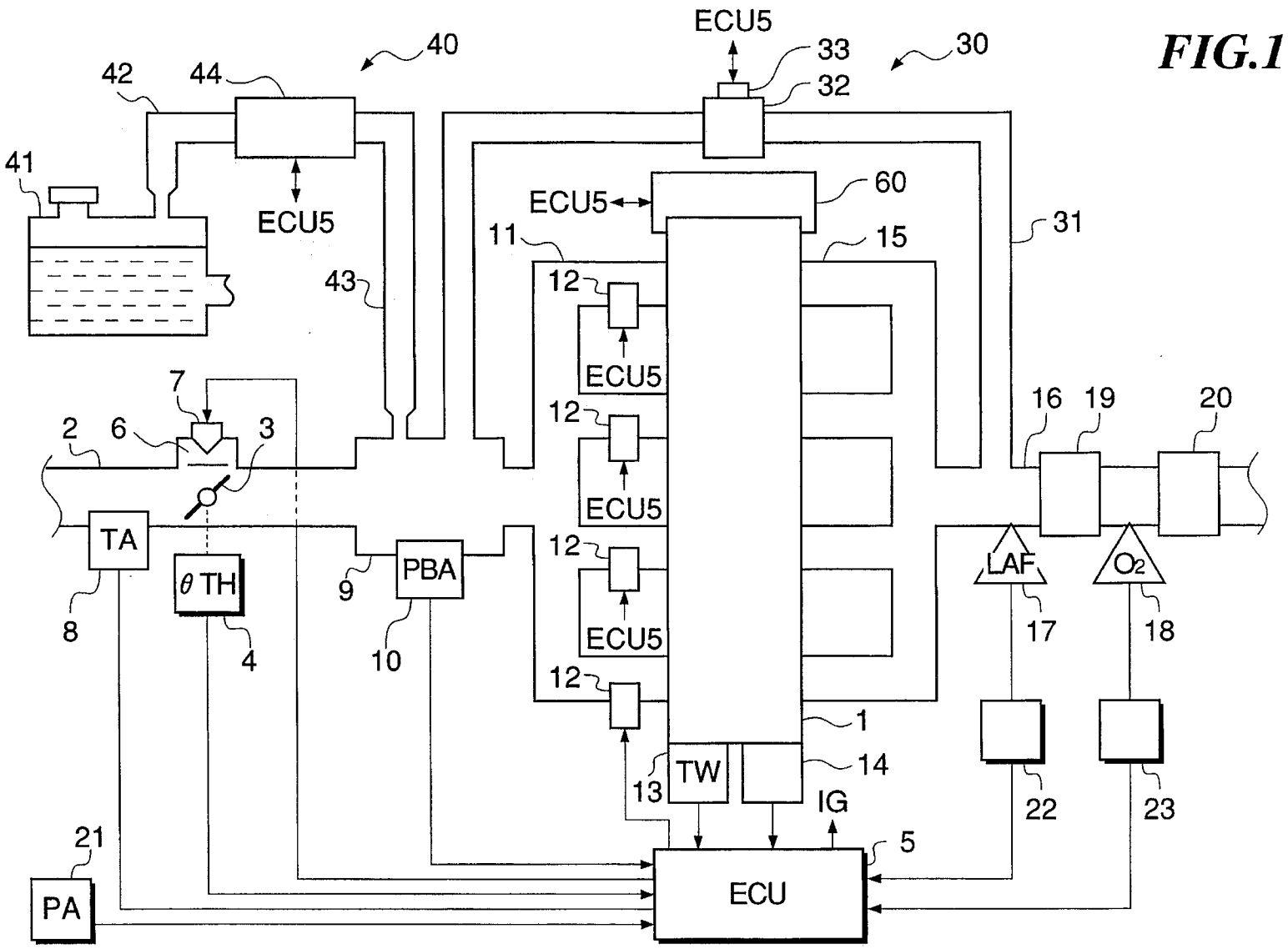
FIG. 1 is a block diagram showing the arrangement of an internal combustion engine and a control system therefor, according to a first embodiment of the invention.

Referring first to FIG. 1, there is schematically shown the whole arrangement of an internal combustion engine and an air-fuel ratio control system therefor, according to an embodiment of the invention. In the figure, reference numeral 1 designates a DOHC straight type four-cylinder internal combustion engine (hereinafter simply referred to as "the engine") having a pair of intake valves and a pair of exhaust valves provided for each cylinder, neither of which are shown.

An intake pipe 2 of the engine 1 is connected to a combustion chamber, not shown, of each cylinder of the engine 1, through a confluent portion (intake manifold) 11. Arranged in the intake pipe 2 is a throttle valve 3 to which is connected a throttle valve opening (θTH) sensor 4, for generating an electric signal indicative of the sensed throttle valve opening θTH and supplying the same to an electronic control unit (hereinafter referred to as "the ECU") 5. An auxiliary air passage 6 is provided at the intake pipe 2, which bypasses the throttle valve 3. Arranged in the auxiliary air passage 6 is an auxiliary air amount control valve 7 which is connected to the ECU 5 to have its valve lift controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion as a chamber 9 at a location intermediate between the throttle valve 3 and the intake manifold 11 filled with an engine coolant. An intake pipe absolute pressure (PBA) sensor 10 is provided in communication with the interior of the chamber 9, for supplying an electric signal indicative of the sensed absolute pressure PBA to the ECU 5.

An engine coolant temperature (TW) sensor 13 is mounted in the cylinder block of the engine 1 filled with an engine coolant, for supplying an electric signal indicative of the sensed engine coolant temperature TW to the ECU 5. Connected to the ECU 5 is a crank angle sensor 14 for detecting the rotational angle of a crankshaft, not shown, of the engine 1 and supplying an electric signal indicative of the sensed rotational angle of the crankshaft to the ECU 5.

The crank angle sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing and for detecting the engine rotational speed NE.

Fuel injection valves 12 are inserted into the intake manifold 11 for respective cylinders at locations slightly upstream of the intake valves. The fuel injection valves 12 are connected to a fuel pump, not shown, and electrically connected to the ECU 5 to have fuel injection timing and fuel injection periods (valve opening periods) thereof controlled by signals therefrom. Spark plugs, not shown, of the engine 1 are also electrically connected to the ECU 5 to have ignition timing θIG thereof controlled by signals therefrom.

An exhaust pipe 16 is connected to the combustion chambers of the engine 1 through an exhaust manifold 15. A linear-output oxygen concentration sensor (hereinafter referred to as "the LAF sensor") 17 is arranged in the exhaust pipe 16 at a location immediately downstream of a confluent portion of the exhaust pipe 16. Further arranged in the exhaust pipe 16 are a first three-way catalyst (immediate downstream three-way catalyst) 19 and a second three-way catalyst (bed-downstream three-way catalyst) 20, and an oxygen concentration sensor (hereinafter referred to as "the 02 sensor") 18 inserted into the exhaust pipe 16 at a location intermediate between the three-way catalysts 19, 20. The three-way catalysts 19 and 20 function to purify noxious components in exhaust gases, such as HC, CO, and NOx.

The LAF sensor 17 is connected to the ECU 5 via a low-pass filter 22, for generating an electric signal which is almost proportional in value to the concentration of oxygen (air-fuel ratio) in exhaust gases from the engine and supplying the same to the ECU 5. The 02 sensor 18 has a characteristic that an electromotive force thereof drastically changes when the air-fuel ratio of exhaust gases changes across a stoichiometric air-fuel ratio, so that the 02 sensor 18 generates a high level signal when the air-fuel ratio of the exhaust gases is richer than the stoichiometric air-fuel ratio, and a low level signal when it is leaner than the same. The 02 sensor 18 is connected to the ECU 5 via a low-pass filter 23, for supplying a signal indicative of the sensed oxygen concentration to the ECU 5.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 33 and supplying a signal indicative of the detected valve lift to the ECU 5. The EGR valve 32 is an electromagnetic valve having a solenoid which is connected to the ECU 5, the valve lift of which is linearly changed by a signal from the ECU 5.

Figure 2:
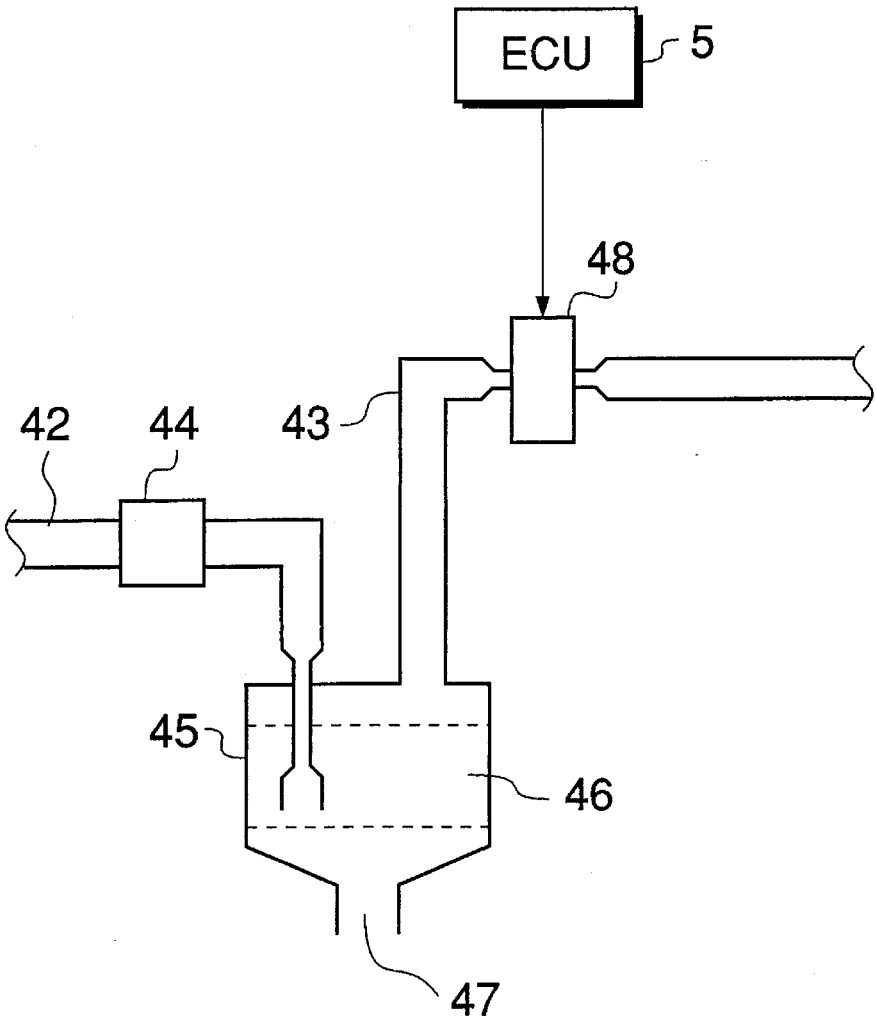
FIG. 2 is a fragmentary diagram showing the arrangement of an evaporative emission control system appearing in FIG. 1.

Next, description will be made of an evaporative emission control system 40 with reference to FIG. 2 as well as to FIG. 1. A fuel tank 41 communicates through a passage 42 with a canister 45 which in turn communicates through a purging passage 43 with the chamber 9 of the intake pipe 2. The canister 45 accommodates therein an adsorbent 46 for adsorbing evaporative fuel generated in the fuel tank 41, and has an air intake port 47. Arranged across the passage 42 is a two-way valve 44 formed of a positive pressure valve and a negative pressure valve. A purge control valve 48 which is an electromagnetic valve of a duty-control type is arranged across the purging passage 43. The purge control valve 48 is electrically connected to the ECU 5 to have its valving operation controlled by a signal therefrom.

The evaporative emission control system 40 operates as follows: When the pressure of evaporative fuel generated in the fuel tank 41 reaches a predetermined pressure value, the evaporative fuel forcibly opens the positive pressure valve of the two-way valve 44 and flows into the canister 45 to be adsorbed by the adsorbent 46 for storage therein. The purge control valve 48 has its valve opening/closing operations controlled by a duty signal from the ECU 5. While the purge control valve 48 is open, evaporative fuel temporarily stored in the canister 45 is drawn into the chamber 9 through the purge control valve 48, together with fresh air taken from the air intake port 47 of the canister 45, to be supplied to each cylinder. Further, when the fuel tank 41 is cooled due to cold fresh air to increase negative pressure within the fuel tank 41, the negative pressure valve of the two-way valve 44 is forcibly opened, whereby evaporative fuel temporarily stored in the canister 45 is returned to the fuel tank 41. In this manner, the evaporative fuel generated in the fuel tank 41 can be prevented from being emitted into the atmosphere.

The engine 1 has a valve timing changeover mechanism 60 which changes valve timing (inclusive of the valve lift) of the intake valves and exhaust valves between a high-speed valve timing suitable for operation of the engine in a high rotational speed region and a low-speed valve timing suitable for operation of the engine in a low rotational speed region. Further, when the low-speed valve timing is selected, one of the two intake valves is rendered inoperative, whereby stable combustion of the engine is secured even when the air-fuel ratio is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are connected to the ECU 5. A signal indicative of the sensed hydraulic pressure is supplied to the ECU 5 which in turn controls the electromagnetic valve for changing the valve timing.

Further connected to the ECU 5 is an atmospheric pressure (PA) sensor 21 for detecting atmospheric pressure and supplying a signal indicative of the sensed value to the ECU 5.

The ECU 5 is comprised of an input circuit having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU"), memory means formed of a ROM storing various operational programs which are executed by the CPU, and a RAM for storing results of calculations therefrom, etc., and an output circuit which delivers driving signals to electromagnetic valves such as the fuel injection valves 12 and the EGR valve 32, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the 02 sensor 18, and air-fuel ratio open-loop control regions, and calculates, based upon the determined engine operating conditions, the fuel injection period TOUT over which the fuel injection valves 12 are to be opened, by the use of the following equation (1), to output driving signals for driving the fuel injection valves 12, based on the results of the calculation:

$$TOUT=TIMF\times KTOTAL\times KCMDM\times KFB \quad (1)$$

Figure 3:
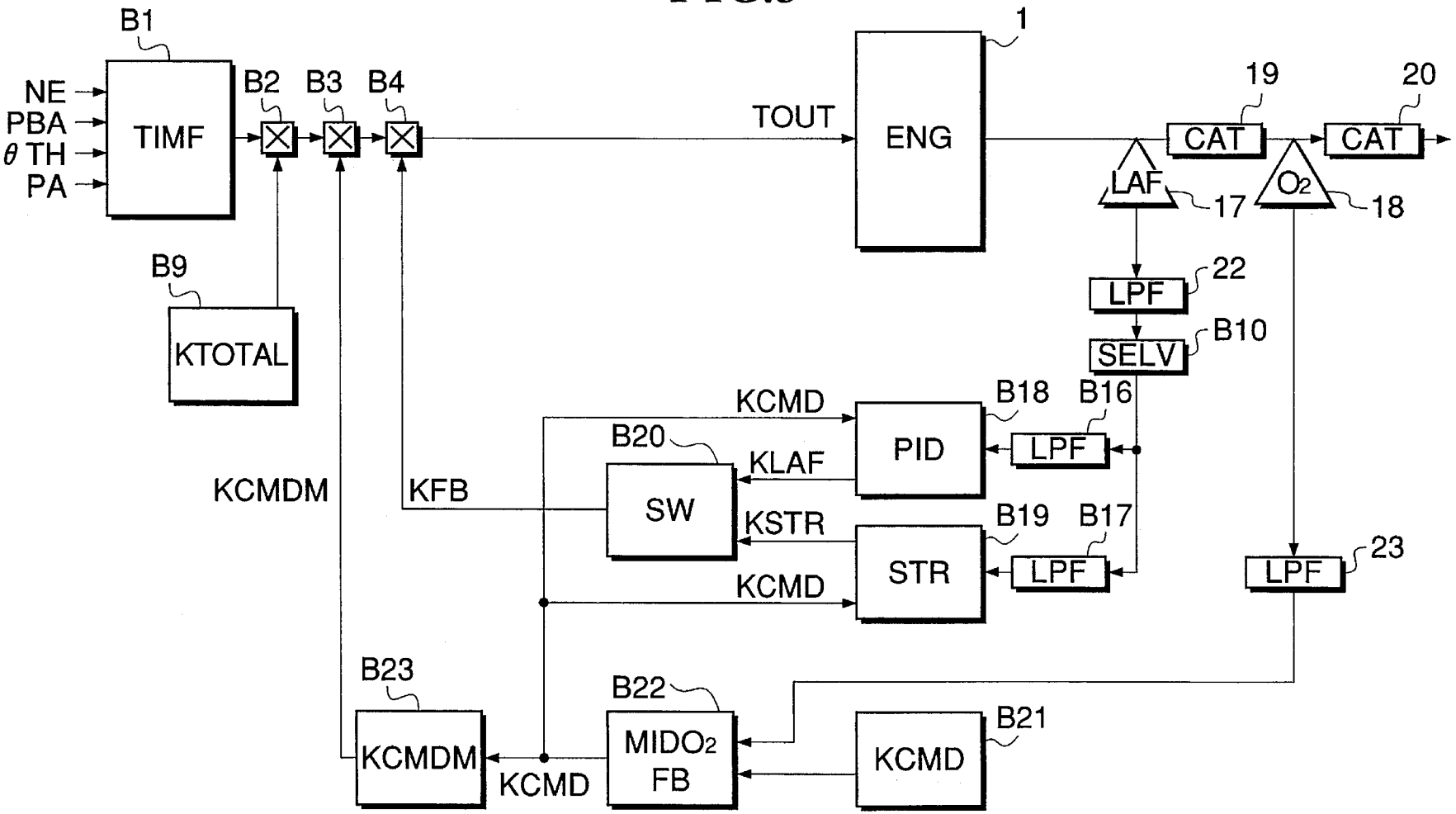
FIG. 3 is a block diagram useful in explaining functions of an air-fuel ratio control section and a manner of calculating a fuel injection period TOUT(N)

FIG. 3 shows an outline of the manner of calculating the fuel injection period TOUT according to the above equation (1), in which various blocks exhibit their functions. In the present embodiment, an amount of fuel supplied to the engine is calculated as the fuel injection period, which corresponds to an amount of fuel to be injected, and therefore the fuel supply amount TOUT will be also referred to as the fuel injection amount or the fuel amount hereinafter.

In the figure, a block B1 calculates a basic fuel amount TIMF based on the intake air amount. The basic fuel amount TIMF is basically set according to the engine rotational speed NE and the intake pipe absolute pressure PBA. Preferably, a model is prepared in advance, which represents a portion of the engine extending from the throttle valve 3 of the intake system to the combustion chamber, and a correction is made to the TIMF value in dependence on a delay of the flow of intake air obtained on the model. In this preferred method, the throttle valve opening θTH and the atmospheric pressure PA are also used as additional parameters indicative of operating conditions of the engine 1.

Reference numerals B2 to B4 designates multiplying blocks, which multiply the basic fuel amount TIMF by parameter values input thereto, and deliver the product values. These blocks carry out the arithmetic operation of the equation (1), to thereby obtain fuel injection amounts TOUT for the respective cylinders.

A block B9 multiplies together all feed-forward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purging-dependent correction coefficient KPUG set according to the purged fuel amount during purging by the evaporative emission control system 40, to thereby obtain the correction coefficient KTOTAL which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VM02 from the 02 sensor 18 supplied via the low-pass filter 23, and delivers the corrected KCMD value to a block B18 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values into a ring buffer memory, not shown, and selects one of the stored values depending on operating conditions of the engine (LAF sensor output-selecting processing), which was sampled at the optimum timing for each cylinder, to supply the selected value to the block B18 and a block B19 via low-pass filter blocks B16 and B17. The LAF sensor output-selecting processing eliminates the inconvenience that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates a PID correction coefficient KLAF through PID control based on the difference between the actual air-fuel ratio and the desired air-fuel ratio and delivers the calculated KLAF value to the block B20. The block B19 calculates an adaptive control correction coefficient KSTR through adaptive control (Self-Tuning Regulation), based on the detected air-fuel ratio, and delivers the calculated KSTR value to the block B20. The reason for employing the adaptive control is as follows: If the basic fuel amount TIMF is merely multiplied by the desired air-fuel ratio coefficient KCMD (KCMDM), the resulting desired air-fuel ratio and hence the detected air-fuel ratio may become dull due to a response lag of the engine. The adaptive control is employed to dynamically compensate for the response lag of the engine to thereby improve the toughness of the air-fuel ratio control against external disturbances.

The block B20 selects either the PID correction coefficient KLAF or the adaptive control correction coefficient KSTR supplied thereto, depending upon operating conditions of the engine, and delivers the selected correction coefficient as a feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated by the ordinary PID control in response to the output from the LAF sensor 17, or the adaptive control correction coefficient KSTR calculated by the adaptive control is selectively applied as the correction coefficient KFB to the equation (1) to calculate the fuel injection amount TOUT. When the correction coefficient KSTR is applied, the responsiveness of the air-fuel ratio control exhibited when the desired air-fuel ratio is changed and the toughness of the air-fuel ratio control against external disturbances can be improved, and hence the purification rate of the catalysts can be improved to ensure excellent exhaust emission characteristics of the engine in various operating conditions of the engine.

In the present embodiment, the functions of the various blocks in FIG. 3 are each performed by arithmetic operations by the CPU of the ECU 5, which will be described in detail with reference to flowcharts for carrying out the operations.

Figure 4:
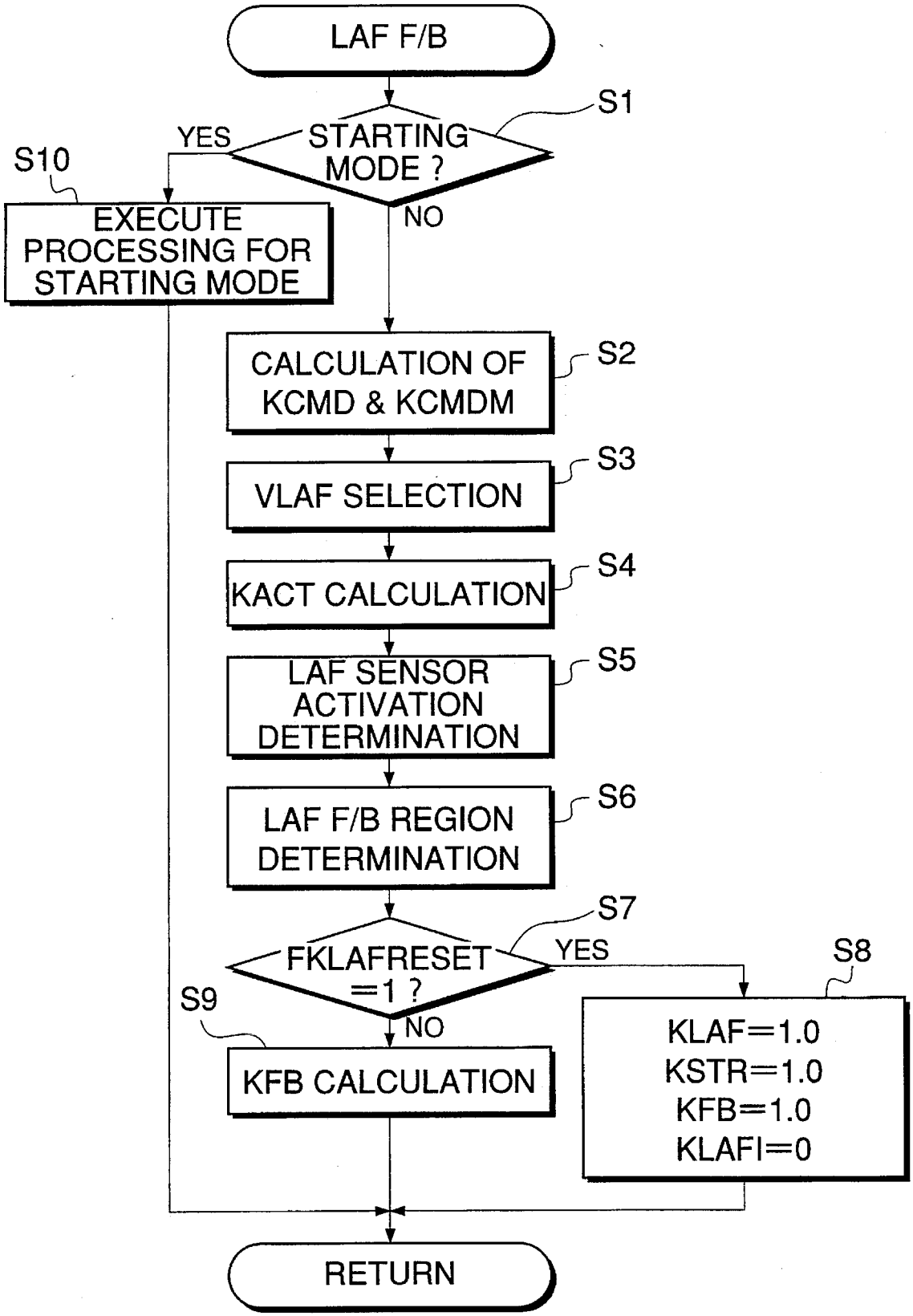
FIG. 4 is a flowchart showing a routine for calculating feedback correction coefficients, based on an output from a LAF sensor appearing in FIG. 1.

FIG. 4 shows a routine for calculating the PID correction coefficient KLAF and the adaptive control correction coefficient KSTR, according to the output from the LAF sensor 17. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S14 to execute a subroutine for the starting mode. If the engine is not in the starting mode, the desired air-fuel ratio coefficient (the desired equivalent ratio) KCMD and the final desired air-fuel ratio coefficient KCMDM are calculated at a step S2, and the LAF sensor output-selecting processing is executed at a step S3. Further, the actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region e.g. when the LAF sensor 17 has been activated but at the same time neither fuel cut nor wide open throttle operation is being carried out. If it is determined at this step that the engine is not in the LAF feedback control region, a reset flag FKLAFRESET is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRESET=1, the program proceeds to a step S8, wherein the PID correction coefficient KLAF, the adaptive control correction coefficient KSTR, and the feedback correction coefficient KFB are all set to "1.0", and an integral term KLAFI of the PID control is set to "0", followed by terminating the present program. On the other hand, if FKLAFRESET=0 holds, the feedback correction coefficient KFB is calculated at a step S9, followed by terminating the present program.

Figure 5:
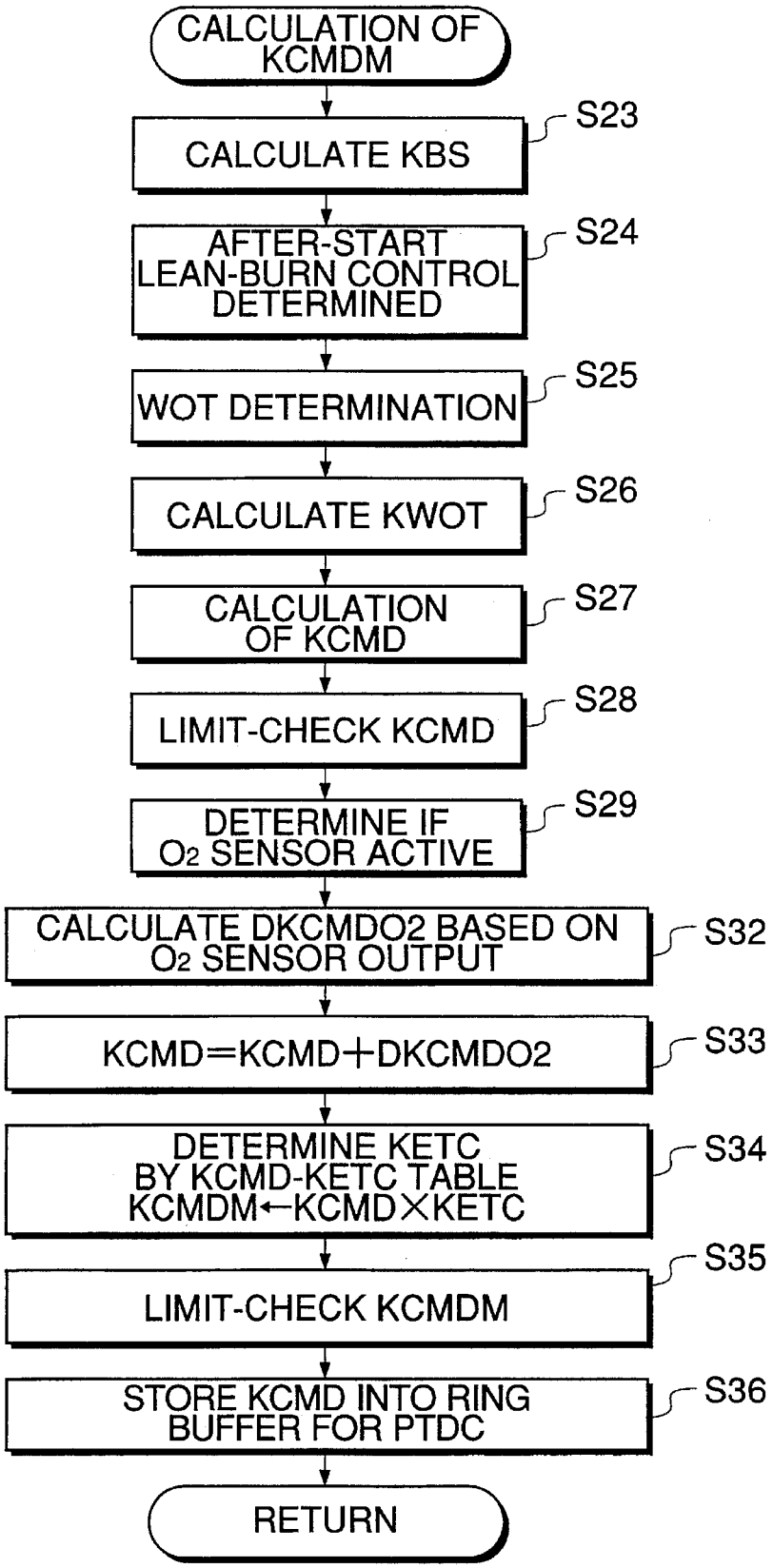
FIG. 5 is a flowchart showing a subroutine for calculating a final desired air-fuel ratio coefficient KCMDM, which is executed at a step S2 in FIG. 4.

FIG. 5 shows a subroutine for executing the step S2 of the FIG. 4 routine to calculate the final desired air-fuel ratio correction coefficient KCMDM.

At a step S23, a basic value KBS is determined by retrieving a map according to the engine rotational speed NE and the intake pipe absolute pressure PBA. The map also contains values of the basic value KBS to be applied during idling of the engine.

At the following step S24, it is determined whether or not conditions for carrying out so-called after-start lean-burn control are fulfilled (after-start leaning determination). If the conditions are fulfilled, an after-start leaning flag FASTLEAN is set to "1", whereas if they are not fulfilled, the flag FASTLEAN is set to "0". The conditions for the after-start lean-burn control are determined to be fulfilled when a predetermined time period has not elapsed after the start of the engine and at the same time the engine coolant temperature TW, the engine rotational speed NE and the intake pipe absolute pressure PBA are within respective predetermined ranges. The after-start lean-burn control is carried out for the purpose of preventing an increase in emission of HC occurring when the catalysts are inactive immediately after the start of the engine, as well as reducing the fuel consumption.

Then, at a step S25, it is determined whether or not the throttle valve is fully open (i.e. the engine is in a WOT condition). If the throttle valve is fully open, a WOT flag FWOT is set to "1", whereas if the throttle valve is not fully open, the same flag is set to "0". Then, an enriching correction coefficient KWOT is calculated according to the engine coolant temperature TW at a step S26. At the same time, a correction coefficient KXWOT to be applied in a high coolant temperature condition is also calculated.

At the following step S27, the desired air-fuel ratio coefficient KCMD is calculated, and then limit-checking of the calculated KCMD value is carried out to limit the KCMD value within a range defined by predetermined upper and lower limit values at a step S28. A subroutine for executing the step S27 will be described in detail hereinafter with reference to FIG. 6.

At the following step S29, it is determined whether or not the 02 sensor 18 has been activated. If the 02 sensor 18 has been activated, an activation flag FMO2 is set to "1", whereas if the 02 sensor has not been activated, the same flag is set to "0". The 02 sensor 18 is determined to have been activated e.g. when a predetermined time period has elapsed after the start of the engine. At the following step S32, a correction term DKCMD02 for correcting the desired air-fuel ratio coefficient KCMD is calculated according to the output VM02 from the 02 sensor 18. More specifically, the correction term DKCMD02 is calculated by the PID control according to a difference between the 02 sensor output VM02 and a reference value VREFM.

Then, at a step S33, the desired air-fuel ratio coefficient KCMD is corrected by the use of the following equation (2):

$$KCMD=KCMD+DKCMD02 \quad (2)$$

This correction makes it possible to set the desired air-fuel ratio coefficient KCMD such that a deviation of the LAF sensor output from a proper value is corrected.

At the following step S34, a KCMD-KETC table is retrieved according to the calculated KCMD value to determine a correction coefficient KETC, and the final desired air-fuel ratio coefficient KCMDM is calculated by the use of the following equation (3):

$$KCMDM=KCMD\times KETC \quad (3)$$

The correction coefficient KETC compensates for the influence of fuel cooling effects caused by fuel injection, the degree of which increases as the KCMD value increases to increase the fuel injection amount. The correction coefficient KETC is set to a larger value as the KCMD value is larger.

Then, limit-checking of the calculated KCMDM value is carried out at a step S35, and the KCMD value obtained at the step S33 is stored in a ring buffer memory at a step S36, followed by terminating the subroutine.

Figure 6:
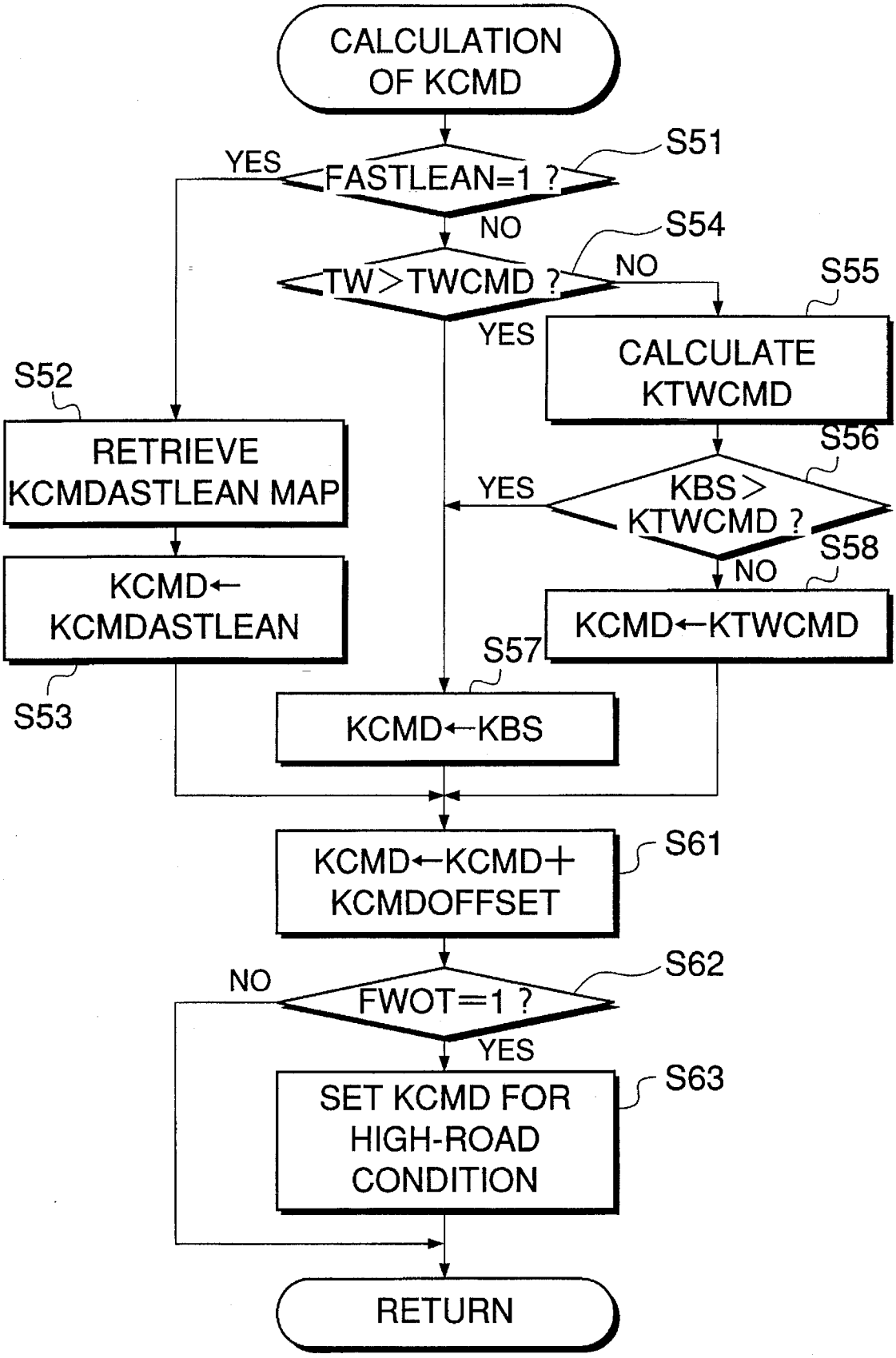
FIG. 6 is a flowchart showing a subroutine for calculating a desired air-fuel ratio coefficient KCMD, which is executed at a step S27 in FIG. 5.

FIG. 6 shows a subroutine for calculating the KCMD value, which is executed at the step S27 in FIG. 5.

First, at a step S51, it is determined whether or not the after-start leaning flag FASTLEAN which has been set at the step S24 in FIG. 5 is equal to "1", and if FASTLEAN=1 holds, a KCMDASTLEAN map is retrieved to determine a leaning desired value KCMDASTLEAN which corresponds to a central air-fuel ratio suitable for the after-start lean-burn control, at a step S52. The KCMDASTLEAN map is set such that map values of the leaning desired value KCMDASTLEAN are set according to the engine coolant temperature TW and the intake pipe absolute pressure PBA. Then, at a step S53 the desired air-fuel ratio coefficient KCMD is set to the thus determined KCMDASTLEAN value, followed by the program proceeding to a step S61.

On the other hand, if FASTLEAN=0 holds at the step S51, which means that the conditions for executing the after-start lean-burn control are not satisfied, it is determined whether or not the engine coolant temperature TW is higher than a predetermined value TWCMD (e.g. 80° C.). If TW>TWCMD holds, the KCMD value is set to the basic value KBS calculated at the step S23 in FIG. 4, at a step S57, followed by the program proceeding to the step S61. If TW≦TWCMD holds, a map which is set according to the engine coolant temperature TW and the intake pipe absolute pressure PBA is retrieved to determine a desired value KTWCMD suitable for low coolant temperature at a step S55, and then it is determined at a step S56 whether or not the basic value KBS is larger than the determined KTWCMD value. If KBS>KTWCMD holds, the program proceeds to the step S57, whereas if KBS≦KTWCMD holds, the KCMD value is replaced by the determined desired value KTWCMD suitable for low coolant temperature at a step S58, followed by the program proceeding to the step S61.

At the step S61, the KCMD value is corrected by the use of the following equation (4), followed by the program proceeding to a step S62:

$$KCMD=KCMD+KCMDOFFSET \quad (4)$$

where KCMDOFFSET represents an addend correction term for finely adjusting the desired air-fuel ratio coefficient KCMD so as to compensate for variations in characteristics of the exhaust system and the LAF sensor of the engine, as well as changes in the exhaust system and the LAF sensor due to aging such that the actual air-fuel ratio assumes an optimum value for window zones of the three-way catalysts. The addend correction term KCMDOFFSET is set based on the characteristics of the LA F sensor 17, etc.. Desirably, the KCMDOFFSET value is a learned value obtained by learning based on the output from the 02 sensor 18, etc.

At a step S62, it is determined whether or not the WOT flag FWOT which has been set at the step S25 in FIG. 5 is equal to "1". If FWOT=0 holds, the program is immediately terminated, whereas if FWOT=1 holds, the desired air-fuel ratio correction coefficient KCMD is set to a value suitable for a high-load condition of the engine at a step S63, followed by terminating the present program. The step S63 is executed more specifically by comparing the KCMD value with the enriching correction coefficients KWOT and KXWOT for the high-load condition of the engine calculated at the step S26 of the FIG. 5 routine, and if the KCMD value is smaller than these values, the KCMD value is multiplied by the correction coefficient KWOT or KXWOT for correction of the same.

Next, the LAF sensor output-selecting processing at the step S3 of the FIG. 4 routine will be described.

Exhaust gases are emitted from the engine on the exhaust stroke, and accordingly clearly the behavior of the air-fuel ratio detected at the confluent portion of the exhaust system of the multi-cylinder engine is synchronous with generation of each TDC signal pulse. Therefore, detection of the air-fuel ratio by the LAF sensor 17 is also required to be carried out in synchronism with generation of each TDC signal pulse. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 7B in comparison with timing of generation of each TDC signal pulse shown in FIG. 7A, the air-fuel ratio recognized by the ECU 5 can have quite different values depending on the timing of sampling, as shown in FIG. 8B. Therefore, it is desirable that the sampling of the output from the LAF sensor 17 should be carried out at such timing as enables the ECU 5 to recognize actual variation of the sensor output as accurately as possible.

Further, the variation of the air-fuel ratio also depends upon a time period required to elapse before exhaust gases emitted from the cylinder reach the LAF sensor 17 as well as upon the response time of the LAF sensor 17. The required time period depends on the pressure and volume of exhaust gases, etc. Further, sampling of the sensor output in synchronism with generation of each TDC signal pulse is equivalent to sampling of the same based on the crank angle position, so that the sampling result is inevitably influenced by the engine rotational speed NE. The optimum timing of detection of the air-fuel ratio thus largely depends upon operating conditions of the engine.

Figures 9A, 9B, 9C, 9D:
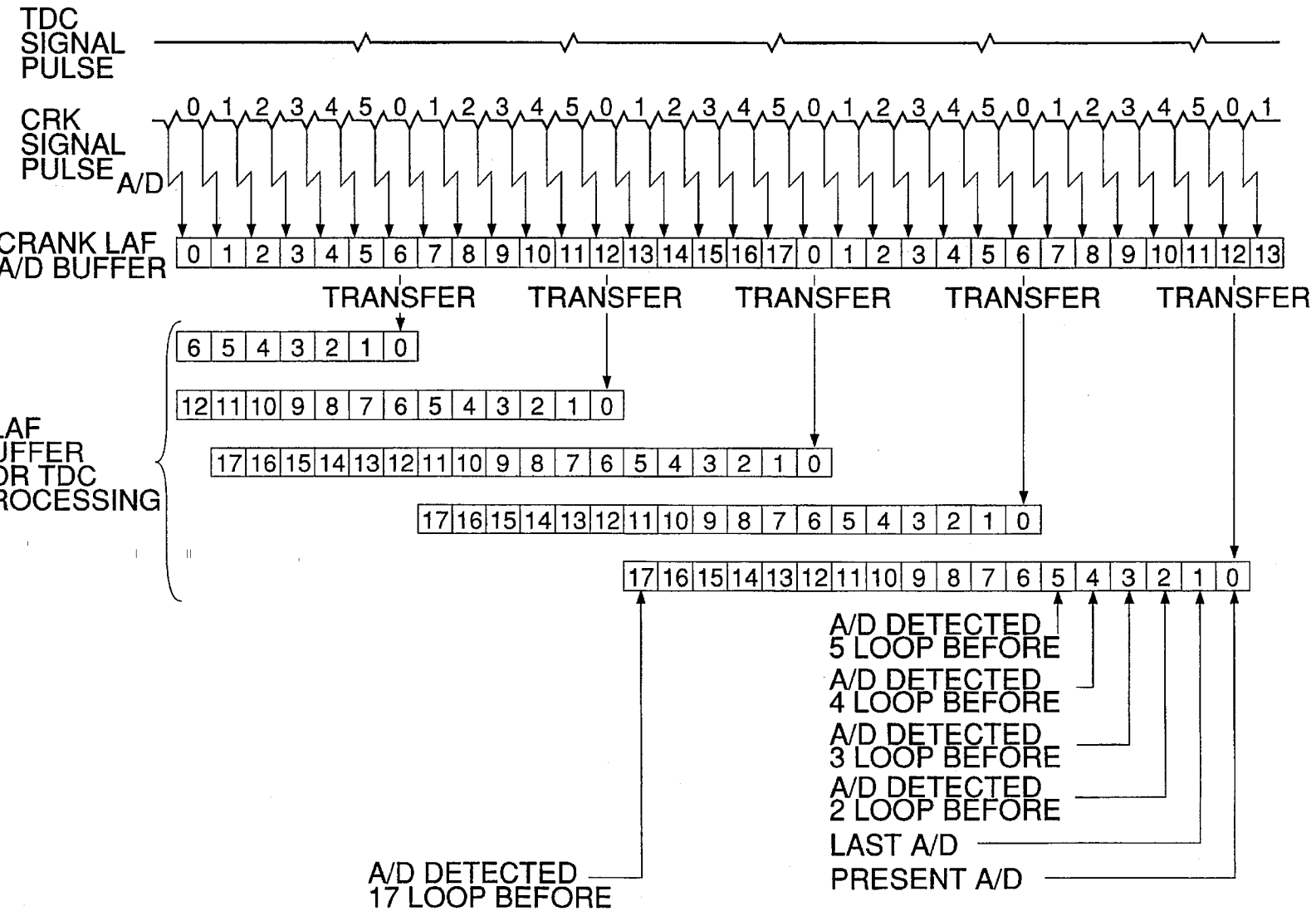
FIG. 9A–9D are a diagram which is useful in explaining how to select a value of the output from the LAF sensor sampled at the optimum timing from values of the same sampled whenever a CRK signal pulse is generated.

In view of the above fact, in the present embodiment, as shown in FIG. 9, values of the output from the LAF sensor 17 sampled in synchronism generation of each CRK signal pulse (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 10:
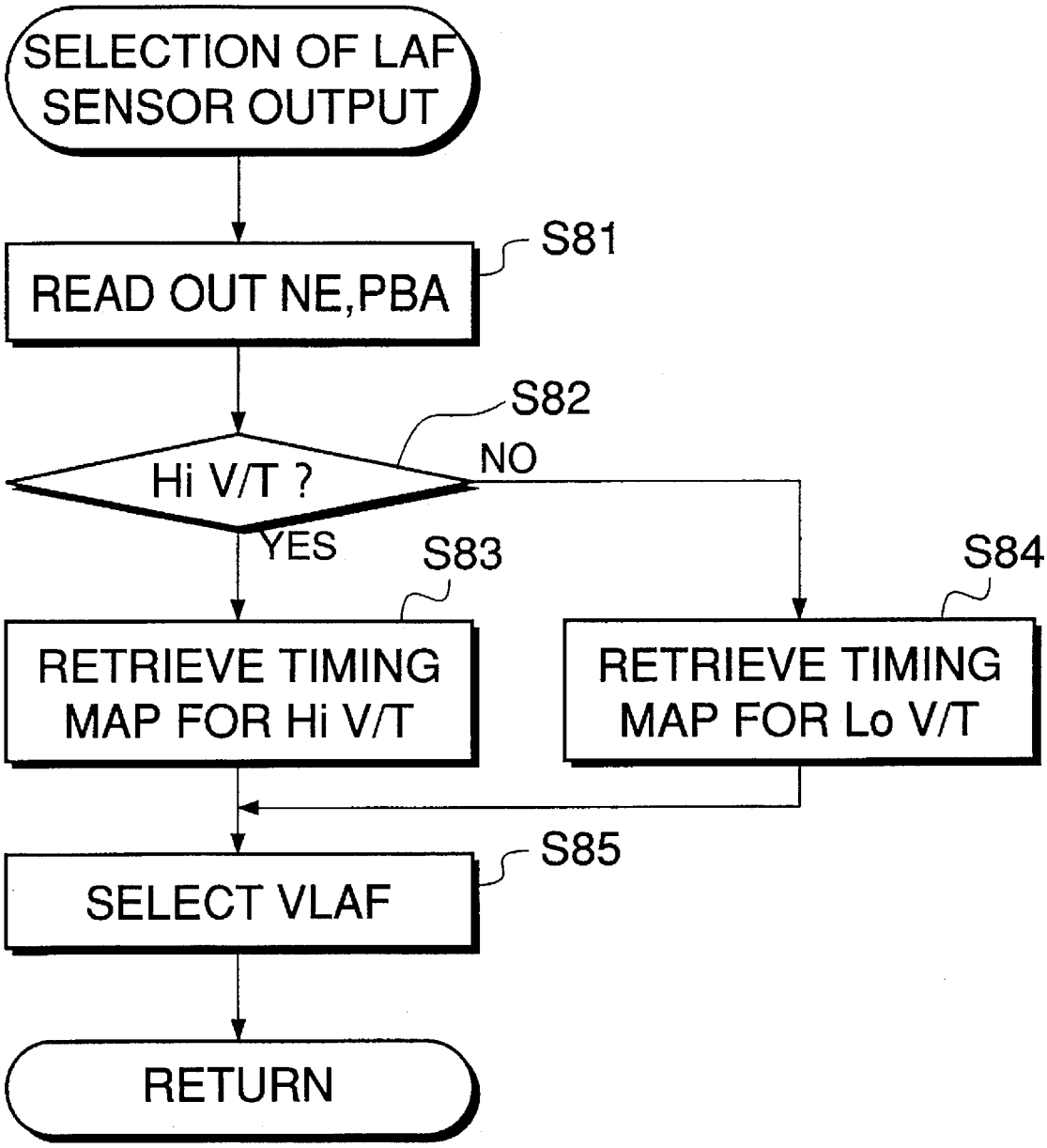
FIG. 10 is a flowchart showing a subroutine for executing a LAF sensor output selection, which is executed at a step S3 in FIG. 4.

FIG. 10 shows a subroutine for carrying out the LAF sensor output selection executed at the step S3 in FIG. 4.

First, at a step S81, the engine rotational speed NE and the intake pipe absolute pressure PBA are read in, and then it is determined at a step S82 whether or not the present valve timing has been set to the high-speed valve timing. If the valve timing has been set to the high-speed valve timing, a timing map suitable for the high-speed valve timing is retrieved at a step S83. On the other hand, if the valve timing has been set to the low-speed valve timing, a timing map suitable for the low-speed valve timing is retrieved at a step S84. Then, based on the result of the retrieval, one of the LAF sensor output values VLAF stored in the ring buffer memory is selected as a selected value VLAFSEL at a step S85, followed by terminating the present subroutine.

Figure 11:
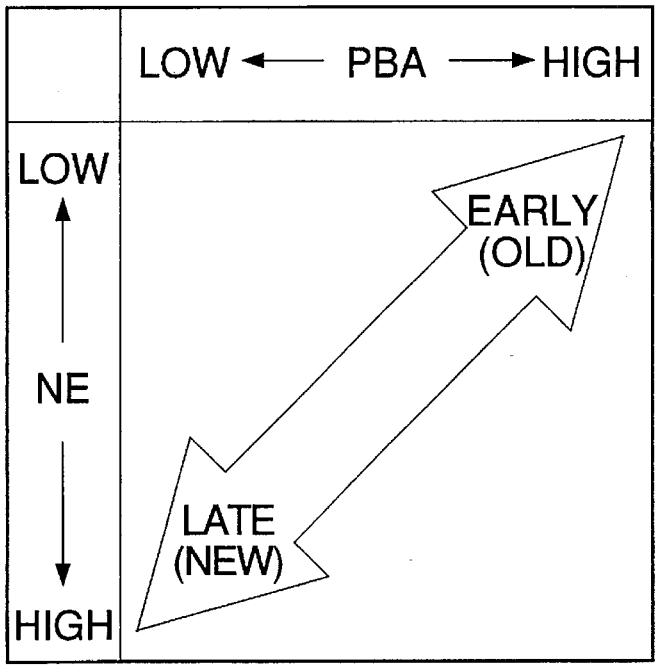
FIG. 11 is a diagram showing characteristics of timing maps used in the FIG. 10 subroutine.
Figure 12A:
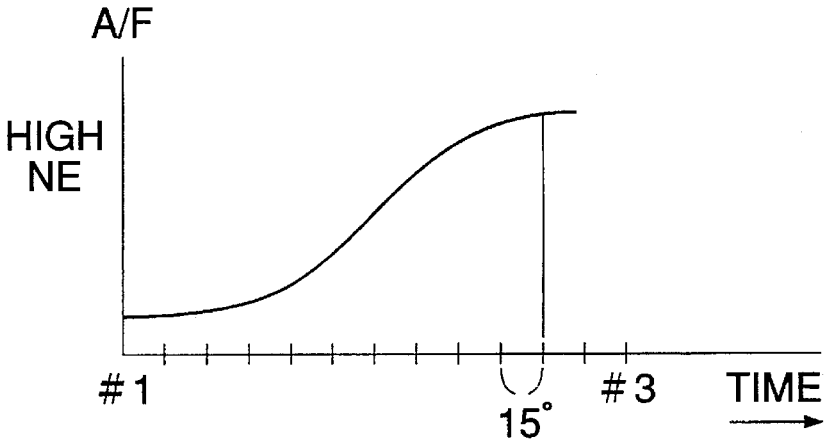
FIG. 12A is a diagram showing characteristics of the output from the LAF sensor assumed at a high engine rotational speed, which is useful in explaining the characteristics of the timing maps shown in FIG. 11.
Figure 12B:
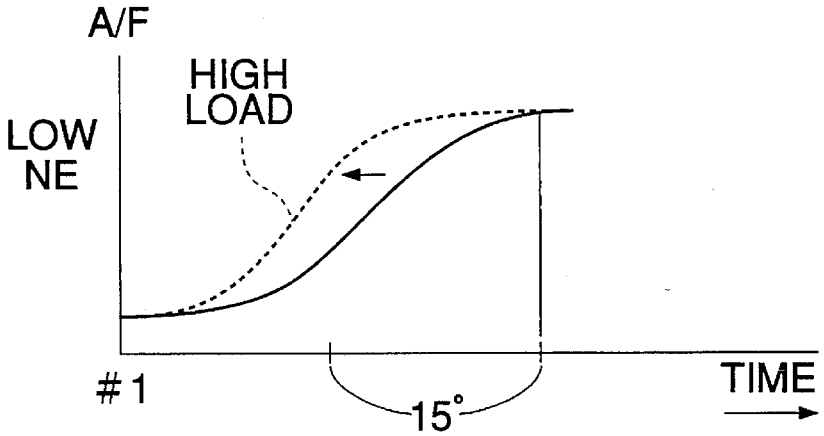
FIG. 12B is a diagram showing characteristics of the output from the LAF sensor assumed at a low engine rotational speed with a shift to be effected when a change in load on the engine occurs, which is useful in explaining the characteristics of the timing maps shown in FIG. 11.

The timing maps are set e.g. as shown in FIG. 11 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that as shown in FIGS. 8A and 8B referred to before, the air-fuel ratio is best sampled at timing closest to time points corresponding to maximal and minimal values (hereinafter both referred to as "extreme values" of he actual air-fuel ratio), and assuming that the response time of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIG. 12A and 12B.

The timing map suitable for the high-speed valve timing is set such that an output value sampled at earlier timing than in the timing map suitable for the low-speed valve timing is selected at the same engine rotational speed NE and the same intake pipe absolute pressure PBA. This is because opening of the exhaust valve at the high-speed valve timing is started at a timing earlier than that at the low-speed valve timing.

In the above described manner, according to the FIG. 10 subroutine, a sensor output VLAF value sampled at the optimum timing is selected depending on operating conditions of the engine, which improves the accuracy of detection of the air-fuel ratio.

Figure 13:
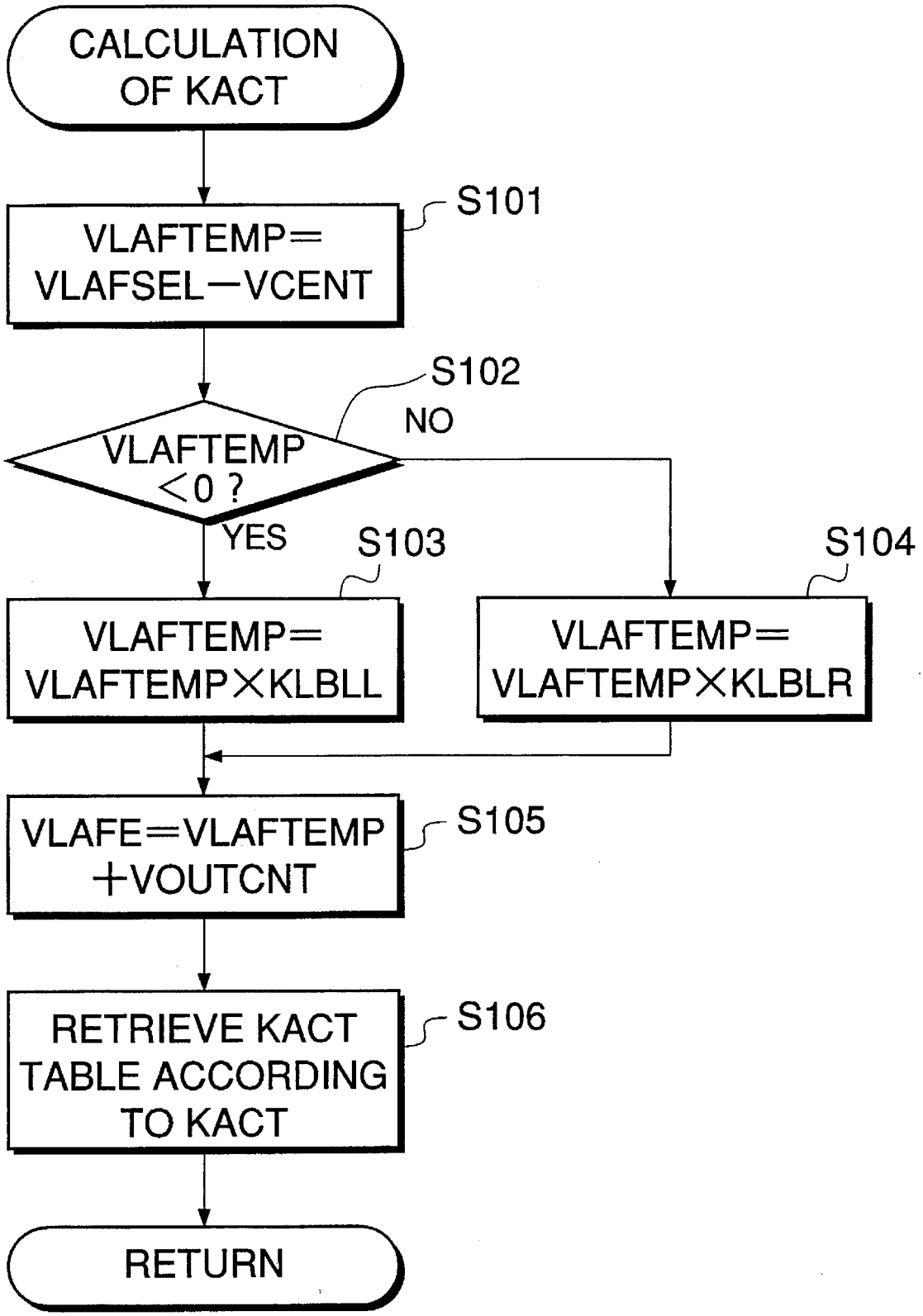
FIG. 13 is a flowchart showing a subroutine for calculating an actual equivalent ratio KACT, which is executed at a step S4 in FIG. 4.

Then, the calculation of the actual equivalent ratio KACT executed at the step S4 of the FIG. 4 routine will be described with reference to FIG. 13.

First, at a step S101, a central value VCENT of the sensor output is subtracted from the selected sensor output value VLAFSEL determined by the FIG. 10 subroutine to obtain a temporary value VLAFTEMP. The central value VCENT is a value of the output from the LAF sensor 17 detected when the air-fuel ratio of the mixture is equal to the stoichiometric air-fuel ratio.

Next, it is determined at a step S102 whether or not the temporary value VLAFTEMP is negative. If VLAFTEMP<0 holds, which means that the actual air-fuel ratio is leaner than the stoichiometric air-fuel ratio, the VLAFTEMP value is multiplied by a lean value correction coefficient KLBLL to correct the same at a step S103. On the other hand, if VLAFTEMP≧0 holds, which means that the air-fuel ratio is richer than the stoichiometric air fuel ratio, the VLAFTEMP value is, multiplied by a rich value correction coefficient KLBLR to correct the same at a step S104. The lean value correction coefficient KLBLL and the rich value correction coefficient KLBLR are calculated according to a label resistance value indicated on the LAF sensor 17 for correcting variations in sensor output value between LAF sensors to be employed. The label resistance value is set according to output characteristics of the LAF sensor measured in advance, and the ECU 5 reads the label resistance value to determine the correction coefficients KLBLL, KLBLR.

At the following step S105, a table central value VOUTCNT is added to the temporary value VLAFTEMP to calculate a corrected output value VLAFE, and a KACT table is retrieved according to the corrected output value VLAFE to determine the actual equivalent ratio KACT at a step S106. In the KACT table, the table central value VOUTCNT corresponds to lattice point data corresponding to the stoichiometric air-fuel ratio (KACT=1.0).

By the above processing, the actual equivalent ratio KACT can be obtained which is free of the influence of undesired variations in output characteristics between individual LAF sensors employed.

Figure 14:
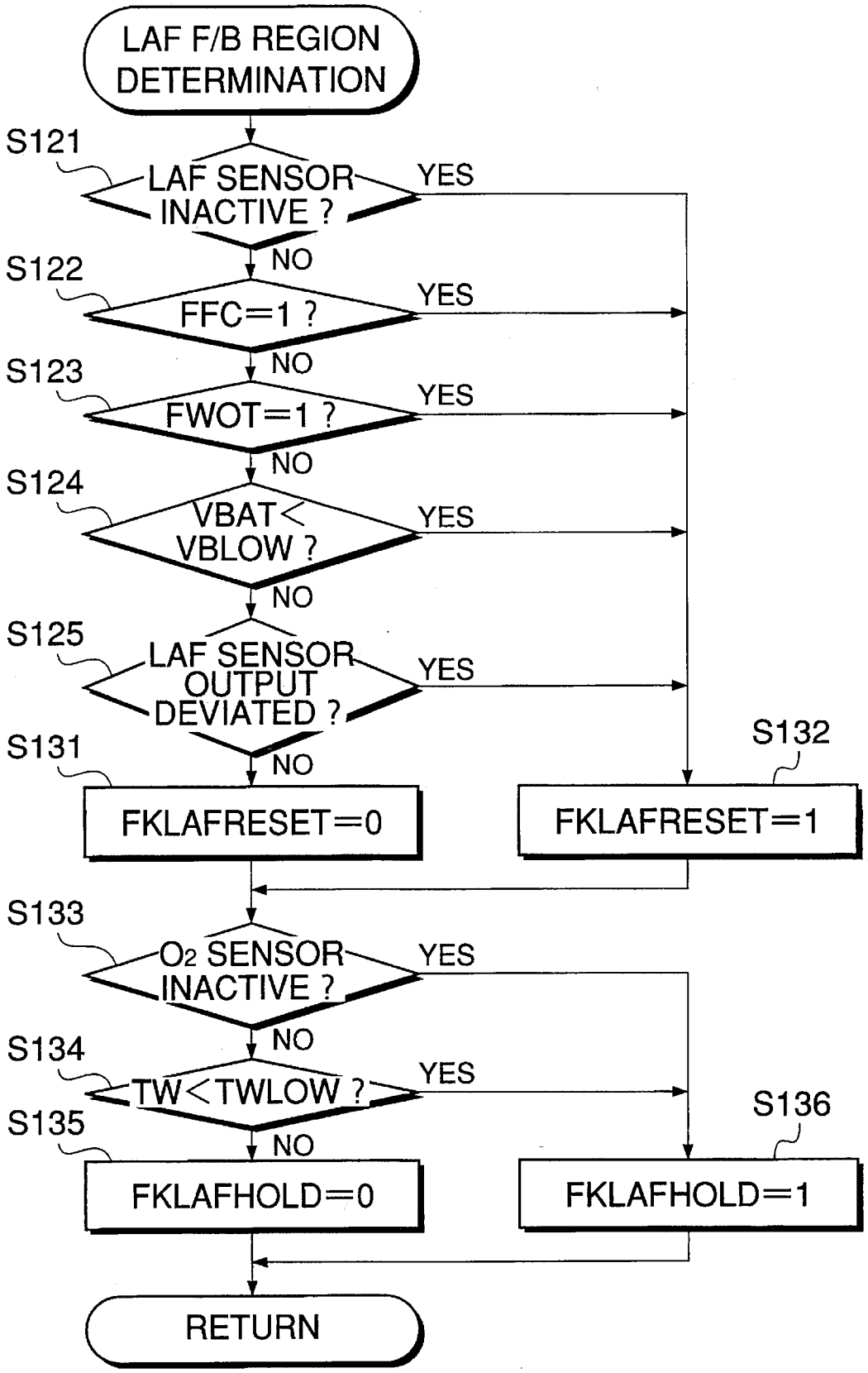
FIG. 14 is a flowchart showing a subroutine for determining whether the engine is operating in an LAF feedback control region, which is executed at a step S6 in FIG. 4.

FIG. 14 shows a LAF feedback control region-determining routine executed at the step S6 in the FIG. 4 routine.

First, at a step S121, it is determined whether or not the LAF sensor 17 is inactive. If the LAF sensor 17 is inactive, it is determined at a step S122 whether or not a flag FFC, which, when set to "1", indicates that fuel cut is being carried out, assumes "1". If FFC=0 holds, it is determined at a step S123 whether or not the WOT flag FWOT, which, when set to "1", indicates that the engine is operating in the wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the KLAF reset flag FKLAFRESET, which, when set to "1", indicates that the feedback control based on the LAF sensor should be inhibited, is set to "1" at a step S132.

On the other hand, if all the answers to the questions of the steps S121 to S125 are negative (NO), the KLAF reset flag FKLAFRESET is set to "0" at a step S131.

At the following step S133, it is determined whether or not the 02 sensor 18 is inactive. If the 02 sensor 18 is active, it is determined at a step S134 whether or not the engine coolant temperature TW is lower than a predetermined lower limit value TWLOW (e.g. 0° C.). If the 02 sensor 18 is inactive or if TW<TWLOW holds, a hold flag FKLAFHOLD, which, when set to "1", indicates that the PID correction coefficient KLAF should be held at the present value, is set to "1" at a step S136, followed by terminating the program. If the 02 sensor 18 is active and at the same time TW≧TWLOW holds, the hold flag FKLAFHOLD is set to "0" at a step S135, followed by terminating the program.

Next, a subroutine for executing the step S9 in the FIG. 4 routine to calculate the feedback correction coefficient KFB will be described.

The feedback correction coefficient KFB is set to the PID correction coefficient KLAF or to the adaptive control correction coefficient KSTR according to operating conditions of the engine. First, manners of calculating these correction coefficients will be described with reference to FIGS. 15 to 18.

Figure 15:
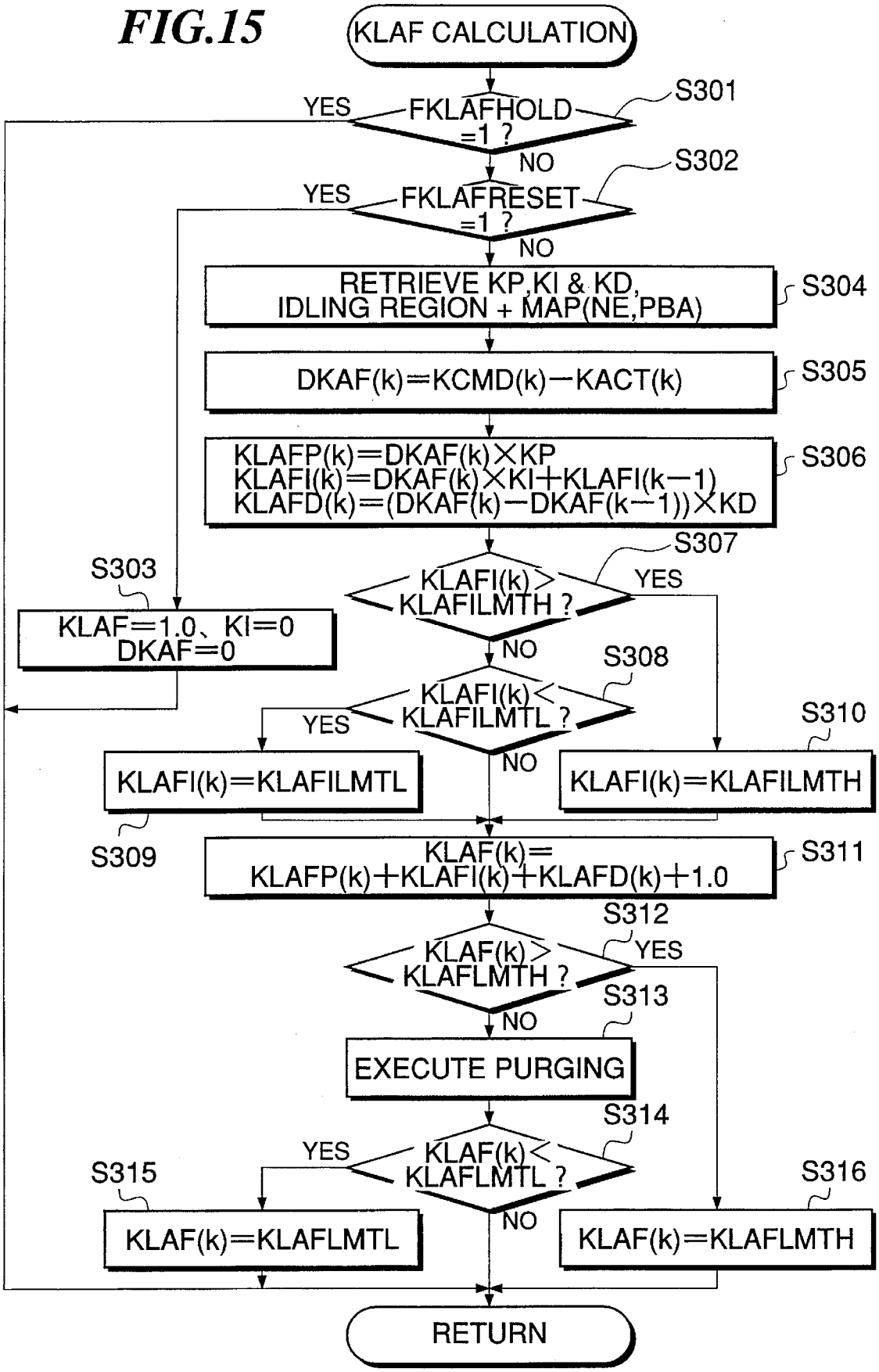
FIG. 15 is a flowchart showing a subroutine for calculating a PID correction coefficient KLAF, which is executed at a step S9 in FIG. 4.

FIG. 15 shows a subroutine for calculating the PID correction coefficient KLAF.

First, at a step S301, it is determined whether or not the hold flag FKLAFHOLD assumes "1". If FKLAFHOLD=1 holds, the present processing is immediately terminated, whereas if FKLAFHOLD=0 holds, it is determined at a step S142 whether or not the KLAF reset flag FKLAFRESET assumes "1". If FKLAFRESET=1 holds, the program proceeds to a step S303, wherein the PID correction coefficient KLAF is set to "1.0" and at the same time an integral term control gain KI and a difference DKAF between the desired equivalent ratio KCMD and the actual equivalent ratio KACT are set to "0", followed by terminating the program.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, the difference DKAF(k) (=KCMD(k)−KACT(k)) between the desired equivalent ratio KCMD and the actual equivalent ratio KACT is calculated at a step S305, and the difference DKAF(k) and the gains KP, KI, and KD are applied to the following equations (5) to (7) to calculate a proportional term KLAFP(k), an integral term KLAFI(k), and a differential term KLAFD(k) at a step S306:

$$KLAFP(k)=DKAF(k)\times KP \tag{5}$$

$$KLAFI(k)=DKAF(k)\times KI+KLAFI(k-1) \tag{6}$$

$$KLAFD(k)=(DKAF(k)-DKAF(k-1))\times KD \tag{7}$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at steps S307 and S308, respectively. If KLAFI(k)>KLAFILMTH holds, the integral term KLAFI(k) is set to the predetermined upper limit value KLAFILMTH at a step S310, whereas if FLAFI(k)<KLAFILMTL holds, the same is set to the predetermined lower limit value KLAFILMTL at a step S309.

At the following step S311, the PID correction coefficient KLAF(k) is calculated by the use of the following equation (8):

$$KLAF(k)=KLAFP(k)+KLAFI(k)+KLAFD(k)+1.0 \tag{8}$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k) KLAFLMTH holds at the step S312, purging, described hereinbelow, is executed at a step S313, and then it is determined at a step S314 whether or not the KLAF(k) value is smaller than a predetermined lower limit value KLAFLMTL. If KLAF(k)≧KLAFLMTL holds, the present program is immediately terminated, whereas if KLAF(k)<KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Figure 16:
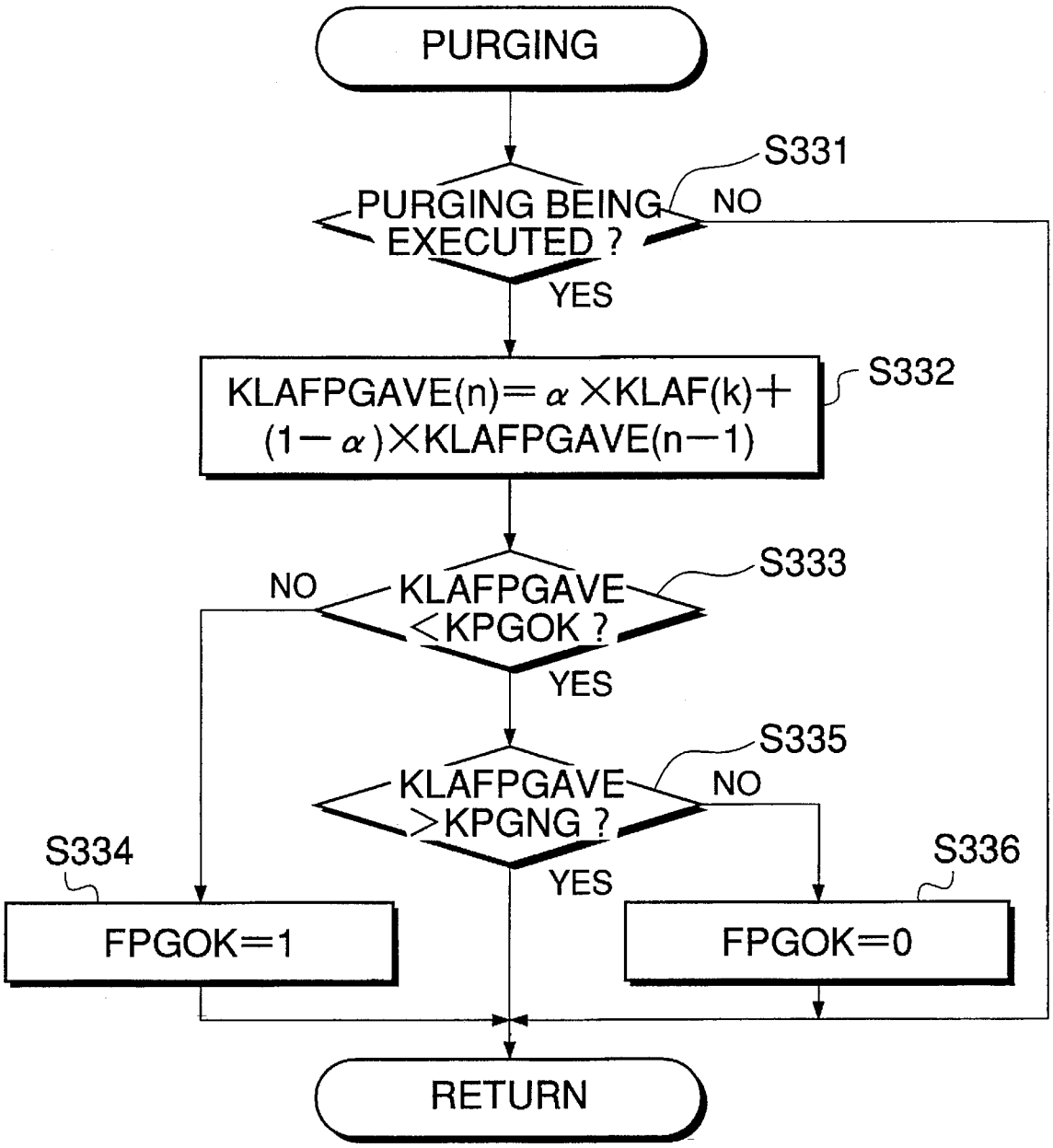
FIG. 16 is a flowchart showing a subroutine for carrying out purging, which is executed at a step S313 in FIG. 15.

FIG. 16 shows a subroutine for carrying out purging executed at the step S313 in FIG. 15.

At a step S331, it is determined whether or not purging is being carried out. If the answer is negative (NO), the program is immediately terminated. On the other hand, if purging is being carried out, an average value KLAFPGAVE(n) of the PID correction coefficient KLAF during purging is calculated by the use of the following equation (9):

$$KLAFPGAVE(n) = \alpha\times KLAF(k) + (1-\alpha)\times KLAFPGAVE(n-1) \tag{9}$$

where (n) and (n−1) represent that the values of the concerned parameter are the present value and the immediately preceding value, respectively. The average value KLAFPGAVE is calculated only during purging, and therefore n is different in meaning from k, hereinafter defined. α represents an averaging coefficient set between 0 and 1.

At the following step S333, it is determined whether or not the average value KLAFPGAVE is smaller than an excessive purging correction coefficient KPGOK to be used in calculation of a valve opening duty ratio DOUTPG of the purge control valve 48. The excessive purge correction coefficient KPGOK is set to 1.0 or a predetermined value KPGNG, referred to hereinbelow. If KLAFPGAVE<KPGOK holds, it is further determined at a step S335 whether or not the KLAFPGAVE value is larger than the predetermined value KPGNG (e.g. 0.5 to 0.8).

If KPGNG<KLAFPGAVE<KPGOK holds, the program is immediately terminated. On the other hand, if KLAFPGAVE≦KPGNG holds, it is determined that the engine is in an excessive purging state, and then an excessive purging flag FPGOK, which, when set to "0", indicates that the engine is in the excessive purging state, is set to "0" at a step S336. If KLAFPGAVE≧KPGOK holds, it is determined that the engine state has been returned from the excessive purging state to a normal state, and then the excessive purging flag FPGOK is set to "1" at a step S334, followed by terminating the present routine.

Thus, if the excessive purging flag FPGOK has been set to "1", the excessive purge correction coefficient KPGOK is set to a non-correction value of 1.0. On the other hand, if FPGKO=0 holds, the excessive purging correction coefficient KPGOK is set to the predetermined value KPGNG smaller than 1.0, i.e. set to a value which corrects the valve opening duty ratio of the purge control valve in a direction of decreasing the duty ratio. Consequently, the excessive purging state can be immediately terminated, to thereby avoid that the fuel injection amount becomes equal or close to zero and hence ensure required stability of the air-fuel ratio feedback control of the engine.

Next, description will be made of calculation of the adaptive control correction coefficient KSTR with reference to FIG. 17.

Figure 17:
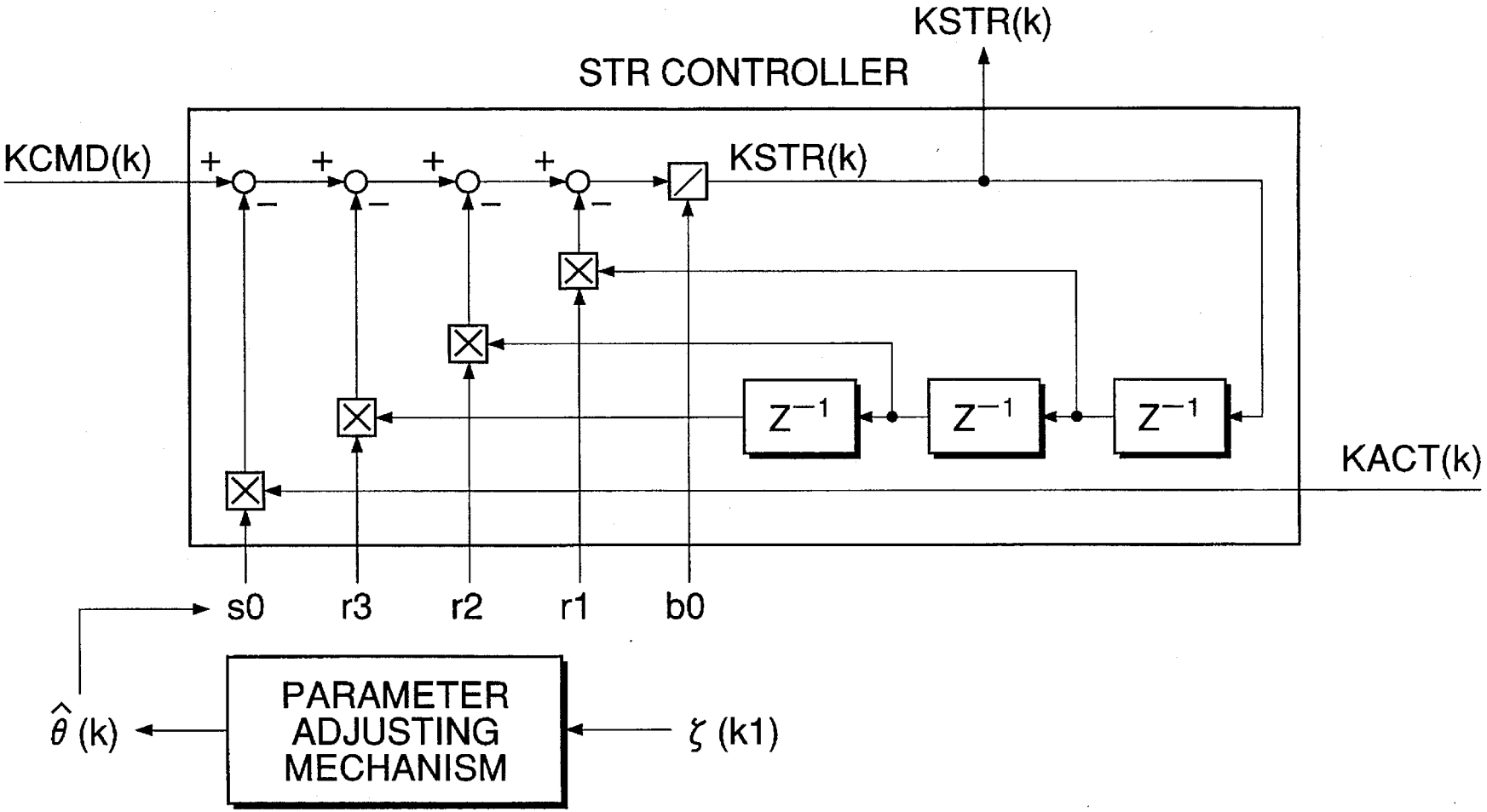
FIG. 17 is a block diagram useful in explaining a manner of calculating an adaptive control correction coefficient KSTR.

FIG. 17 shows the construction of the block B19 in FIG. 3, i.e. the adaptive controller self-tuning regulator (hereinafter referred to as "the STR") block. The STR block is comprised of a STR controller for setting the adaptive control correction coefficient KSTR such that the detected equivalent ratio KACT(k) becomes equal to the desired air-fuel ratio coefficient (desired equivalent ratio) KCMD(k), and a parameter adjusting mechanism for setting parameters to be used by the STR controller.

Adjustment laws (mechanisms) for adaptive control employed in the present embodiment include a parameter adjustment law proposed by Landau et al. According to this law, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This method is known and described e.g. in "Computrole" No. 27, CORONA PUBLISHING CO., LTD., Japan, pp. 28–41, "Automatic control handbook" OHM, LTD., Japan, pp. 703–707, "A Survey of Model Reference Adaptive Techniques Theory and Application", I. D. LANDAU "Automatica" Vol. 10, pp. 353–379, 1974, "Unification of Discrete Time Explicit Model Reference Adaptive Control Designs", I. D. LANDAU et al. "Automatica" Vol. 17, No. 4, 593–611, 1981, and "Combining Model Reference Adaptive Controllers and Stochastic Self-tuning Regulators", I. D. LANDAU "Automatica" Vol. 18, No. 1., pp. 77–84, 1982.

In the present embodiment, the above parameter adjustment law proposed by Landau et al. is employed. This parameter adjustment law will be described in detail, hereinbelow: According to this adjustment law, if polynomials of the denominator and numerator of the transfer function $A(Z^{-1})/B(Z^{-1})$ of the object of control by a discrete system are expressed by the following equations (10) and (11), the adaptive parameter $\hat{\theta}^T(k)$ and the input $\zeta^T(k)$ to the adaptive parameter adjusting mechanism are defined by the following equations (12) and (13). The equations (10) to (13) define an example of a plant in which m=1, n=1 and d=2 hold, i.e. a system of the first order thereof has an ineffective time as long as two control cycles. The symbol k used herein indicates that the parameter with (k) has the present value, one with (k−1) the immediately preceding value, and so forth. u(k) and y(k) correspond to the KSTR(k) and KACT(k) values, respectively, in the present embodiment.

$$A(z^{-1}) = 1 + a_1 z^{-1} + \ldots + a_n z^{-n} \tag{10}$$

$$B(z^{-1}) = b_0 + b_1 z^{-1} + \ldots + b_m z^{-m} \tag{11}$$

$$\begin{aligned}\theta^T(k) &= [b_0(k), r_1(k), \ldots rm + d - 1(k), \\ &\quad S_0(k), \ldots, Sn - 1(k)] \\ &= [b_0(k), r_1(k), r_2(k), r_3(k), s_0(k)]\end{aligned} \tag{12}$$

$$\begin{aligned}\zeta^T(k) &= [u(k), \ldots, u(k - m - d + 1), y(k), \\ &\quad \ldots, y(k - n + 1)] \\ &= [u(k), u(k-1), u(k-2), \\ &\quad u(k-3), y(k)]\end{aligned} \tag{13}$$

The adaptive parameter $\hat{\theta}(k)$ is expressed by the following equation (14):

$$\hat{\theta}(k)=\hat{\theta}(k-1)+\Gamma(k-1)\zeta(k-d)e^*(k) \tag{14}$$

where the symbols Γ(k) and e*(k) represent a gain matrix and an identification error signal, respectively, and can be expressed by the following recurrence formulas (15) and (16):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k) + \lambda_2(k)\zeta^T(k-d)\Gamma(k-1)\zeta(k-d)}\right] \tag{15}$$

$$e^*(k) = \frac{d(z^{-1})y(k) - \hat{\theta}^T(k-1)\zeta(k-d)}{1 + \zeta^T(k-d)\Gamma(k-1)\zeta(k-d)} \tag{16}$$

Further, it is possible to provide various specific algorithms depending upon set values of λ1(k) and λ2(k). For example, if λ1(k)=1 and λ2(k)=λ(0<λ1<2), a progressively decreasing gain algorithm is provided (if λ=1, the least square method), if λ1(k)=λ1 (0<λ1<1) and λ2(k)=λ2 (0<λ2<2), a variable gain algorithm (if λ2=1, the method of weighted least squares), and if λ1(k)/λ2(k)=λ and if λ3 is expressed by the following equation (17), λ1(k)=λ3 provides a fixed trace algorithm. Further, if λ1(k)=1 and λ2(k)=0, a fixed gain algorithm is obtained. In this case, as is clear from the equation (14), Γ(k)=Γ(k−1), and hence Γ(k)=Γ(fixed value) is obtained.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \tag{17}$$

In the example of FIG. 17, the STR controller (adaptive controller) and the adaptive parameter adjusting mechanism are arranged outside the fuel injection amount-calculating system, and operate to calculate the feedback correction coefficient KSTR(k) such that the actual air-fuel ratio KACT(k) becomes equal to the desired air-fuel ratio coefficient KCMD(k-d') (d' represents the above-mentioned ineffective time period before the KCMD value reflects on the actual air-fuel ratio KACT) in an adaptive manner.

In this manner, the adaptive control correction coefficient KSTR(k) and the actual equivalent ratio KACT(k) are determined, which are input to the adaptive parameter-adjusting mechanism, where the adaptive parameter $\hat{\theta}(k)$ is calculated to be input to the STR controller. The STR controller is also supplied with the desired equivalent ratio coefficient KCMD(k) and calculates the adaptive control correction coefficient KSTR(k) such that the actual equivalent ratio KACT(k) becomes equal to the desired equivalent ratio coefficient KCMD(k), by the use of the following recurrence formula (18):

$$KSTR(k) = \frac{KCMD(k-d') - s_0 \times KACT(k) - r_1 \times KSTR(k-1) - r_2 \times KSTR(k-2) - r_3 \times KSTR(k-3)}{b_0} \tag{18}$$

Figure 18:
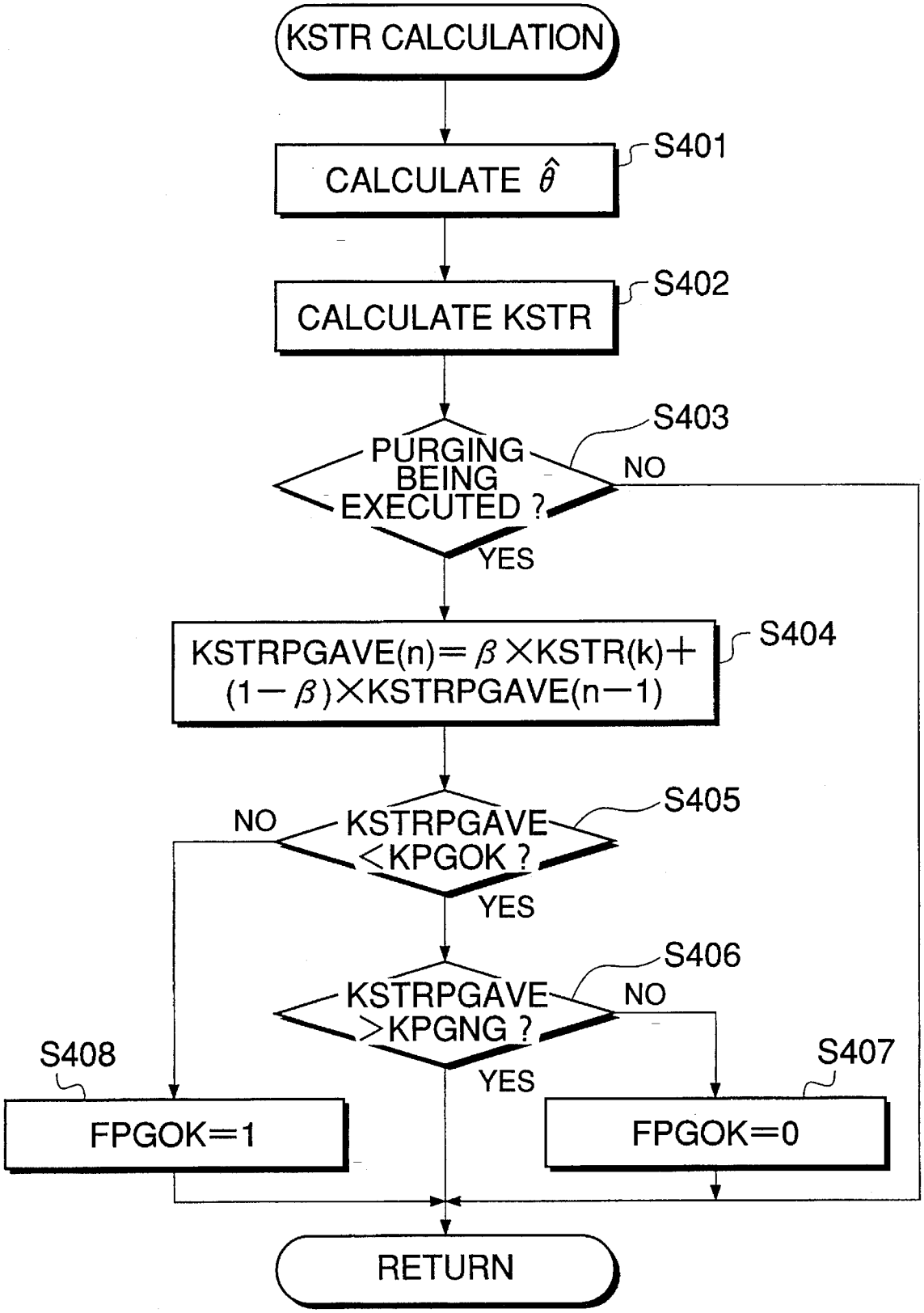
FIG. 18 is a flowchart showing a subroutine for calculating the KSTR value, which is executed at the step S9 in FIG. 4.

FIG. 18 shows a subroutine for calculating the adaptive control correction coefficient KSTR in the above described manner. At a step S401, the adaptive parameter $\hat{\theta}(k)$ is calculated, and then the adaptive control correction coefficient KSTR is calculated by the use of the the thus calculated adaptive parameter $\hat{\theta}(k)$, according to the above equation (18), at a step S402.

At a step S403, it is determined whether or not purging is being carried out. If the answer is negative (NO), the program is immediately terminated. On the other hand, if purging is being carried out, the average value KSTRPGAVE(n) of the adaptive control correction coefficient KSTR during purging is calculated by the use of the following equation (19):

$$KSTRPGAVE(n) = \beta \times KSTR(k) + (1 - \beta) \times KSTRPGAVE(n-1) \tag{19}$$

where β represents an averaging coefficient set between 0 and 1.

At the following step S405, it is determined whether or not the average value KSTRPGAVE is smaller than the excessive purging correction coefficient KPGOK to be used in calculation of the valve opening duty ratio DOUTPG of the purge control valve 48. If KSTRPGAVE<KPGOK holds, it is further determined at a step S406 whether or not the average value KSTRPGAVE is larger than the predetermined value KPGNG (e.g. 0.50–0.8).

If KPGNG<KSTRPGAVE<KPGOK holds, the program is immediately terminated. On the other hand, if KSTRPGAVE≦KPGNG holds, it is determined that the engine is in an excessive purging state, and then the excessive purging flag FPGOK is set to "0" at a step S407. If KSTRPGAVE≧KPGOK holds, it is determined that the engine state has been returned from the excessive purging state to a normal state, and then the excessive purging flag FPGOK is set to "1" at a step S408, followed by terminating the present routine.

Thus, if the excessive purging flag FPGOK has been set to "1", the excessive purging correction coefficient KPGOK is set to a non-correction value of 1.0, whereas if FPGKO=0 holds, the excessive purge correction coefficient KPGOK is set to the predetermined value KPGNG smaller than 1.0, i.e. set to a value which corrects the valve opening duty ratio of the purge control valve in the direction of decreasing the duty ratio. Consequently, the excessive purging state can be immediately terminated, to thereby ensure required stability of the air-fuel ratio feedback control of the engine. A manner of controlling the valve-opening duty ratio of the purge control valve will be described hereinafter with reference to FIGS. 22 to 24.

Next, a manner of calculation of the feedback correction coefficient KFB by switching between the PID correction coefficient KLAF and the adaptive control correction coefficient KSTR, i.e. by switching between the PID control and the adaptive control.

Figure 19:
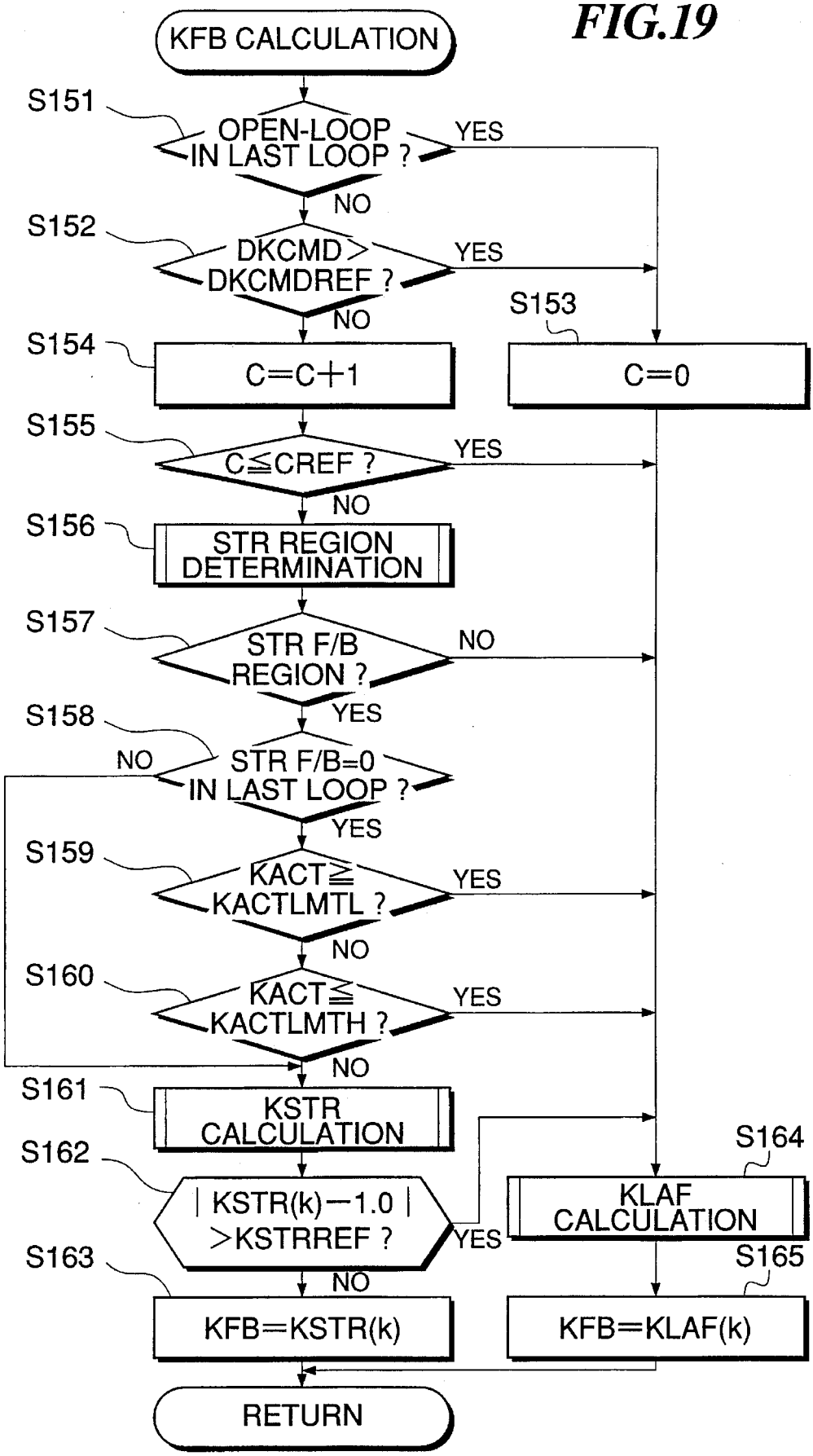
FIG. 19 is a flowchart showing a subroutine for calculating a feedback correction coefficient KFB, which is executed at the step S9 in FIG. 4.

FIG. 19 shows a subroutine for calculating the feedback correction coefficient KFB executed at the step S9 in FIG. 4.

First, it is determined at a step S151 whether or not the control mode was an open-loop control mode in the last loop of execution of the FIG. 4 routine, i.e. if FKLAFRESET=1 holds. If the control mode was not the open-loop control mode, it is determined at a step S152 whether or not a rate of variation DKCMD in the desired equivalent ratio KCMD (=|KCMD(k)−KCMD(k−1|) is larger than a reference value DKCMDREF. If the control mode was the open-loop control mode in the last loop of execution of the FIG. 4 routine, or if the control mode was the feedback control in-the last loop of execution of the FIG. 4 routine and at the same time the rate of variation DKCMD is larger than the reference value DKCMDREF, it is determined that the engine is in a region where the feedback control based on the PID correction coefficient KLAF should be executed (hereinafter referred to as "the PID control region"). Then, a counter C is reset to "0" at a step S153, followed by the program proceeding to a step S164. At the step S164, a PID correction coefficient KLAF calculation is executed, which will now be described with reference to FIG. 21A.

Figure 21A:
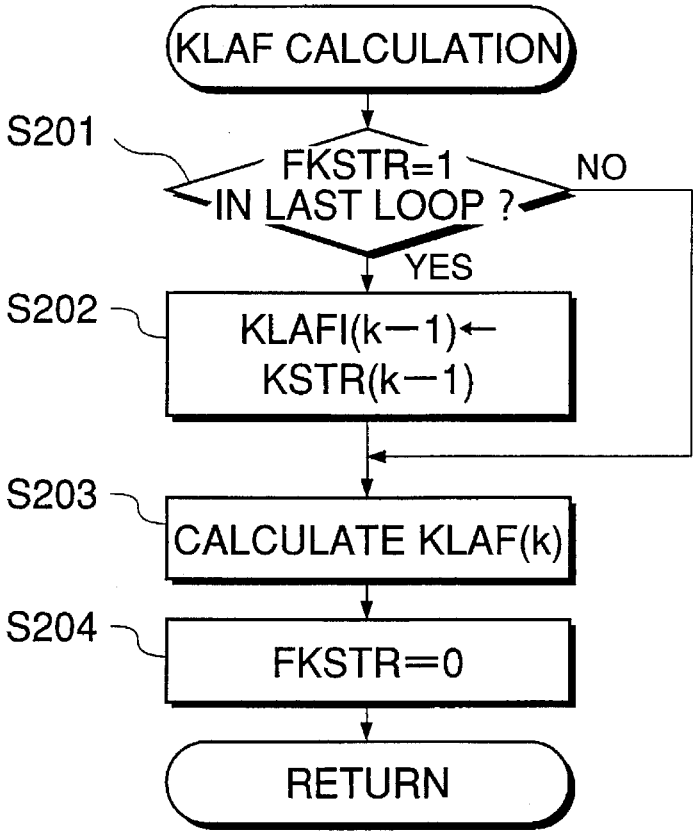
FIG. 21A is a flowchart showing a subroutine for calculating the PID correction coefficient KLAF, which is executed at a step S164 in FIG. 19.

At a step S201 in FIG. 21A, it is determined whether or not a STR flag FKSTR assumed "1" in the last loop of execution of the FIG. 21A routine. The STR flag FKSTR, when set to "1", indicates that the engine is in a region where the feedback control based on the adaptive control correction coefficient KSTR should be executed (hereinafter referred to as "the adaptive control region"). This flag FKSTR is set after the calculation of the feedback control correction coefficient KFB (at a step S204 in FIG. 21A and a step S213 in FIG. 21B).

If FKSTR=0 held in the last loop, the program jumps to a step S203. On the other hand, if FKSTR=1 held in the last loop, the program proceeds to a step S202, wherein the last value KALFI(k−1) of the integral term of the PID control is set to the last value of the adaptive control correction coefficient KSTR(k−1), followed by the program proceeding to the step S203. At the step S203, the PID correction coefficient KLAF is calculated by the aforedescribed processing of FIG. 15, and then the STR flag FKSTR is set to "0" at the step S204, followed by terminating the present routine.

When the adaptive control is switched to the PID control (if the flag FKSTR was set to "1" in the last loop), the integral term KLAFI of the PID control can be suddenly changed, and therefore the KLAFI(k−1) value is set to the KSTR(k−1) value at the step S202. By virtue of this setting, the difference between the adaptive control correction coefficient KSTR(k−1) and the PID correction coefficient KLAF(k) can be kept small, to thereby enable smooth switching from the adaptive control to the PID control and hence ensure required stability of the air-fuel ratio feedback control.

Referring again to the FIG. 19 program, at a step S165, the feedback correction coefficient KFB is set to the PID correction coefficient KLAF(k) calculated at the step S164, followed by terminating the present routine.

The reason why the PID control should be executed when the control mode was the open-loop control mode in the last loop is as follows: For example, when the engine operating condition has just returned from a fuel cut mode to the feedback control mode, the detected air-fuel ratio do not always indicate the actual value of the air-fuel ratio due to the response lag of the LAF sensor, which can result in unstable control of the air-fuel ratio if the adaptive control is executed. For a similar reason to the above, it is also determined that the PID control should be executed when the rate of variation DKCMD in the desired equivalent ratio KCMD is large, for example, when the engine operating condition has just returned from a throttle valve fully open state to an ordinary load condition, or when the engine operating condition has just returned from the lean-burn control to the stoichiometric air-fuel ratio control.

If the answers to the questions of the steps S151 and S152 are both negative (NO), i.e. if the control mode was the feedback control mode in the last loop and at the same time the rate of variation DKCMD in the desired equivalent ratio KCMD is lower than the reference value DKCMDREF, the count value of the counter C is incremented by "1" at a step S154, and then the count value of the counter C is compared with a predetermined value CREF (e.g. 5) at a step S155. If the count value is smaller than the CREF value, the program proceeds to the step S164.

The reason why the PID control should be executed when the count value of the counter C is smaller than the reference value CREF is as follows: Immediately after returning of the engine operating condition from the open, loop control or immediately after a large variation in the desired equivalent ratio KCMD, a time lag before completion of fuel combustion, and a response lag of the LAF sensor are so large that influences thereof cannot be compensated for by the adaptive control.

Figure 20:
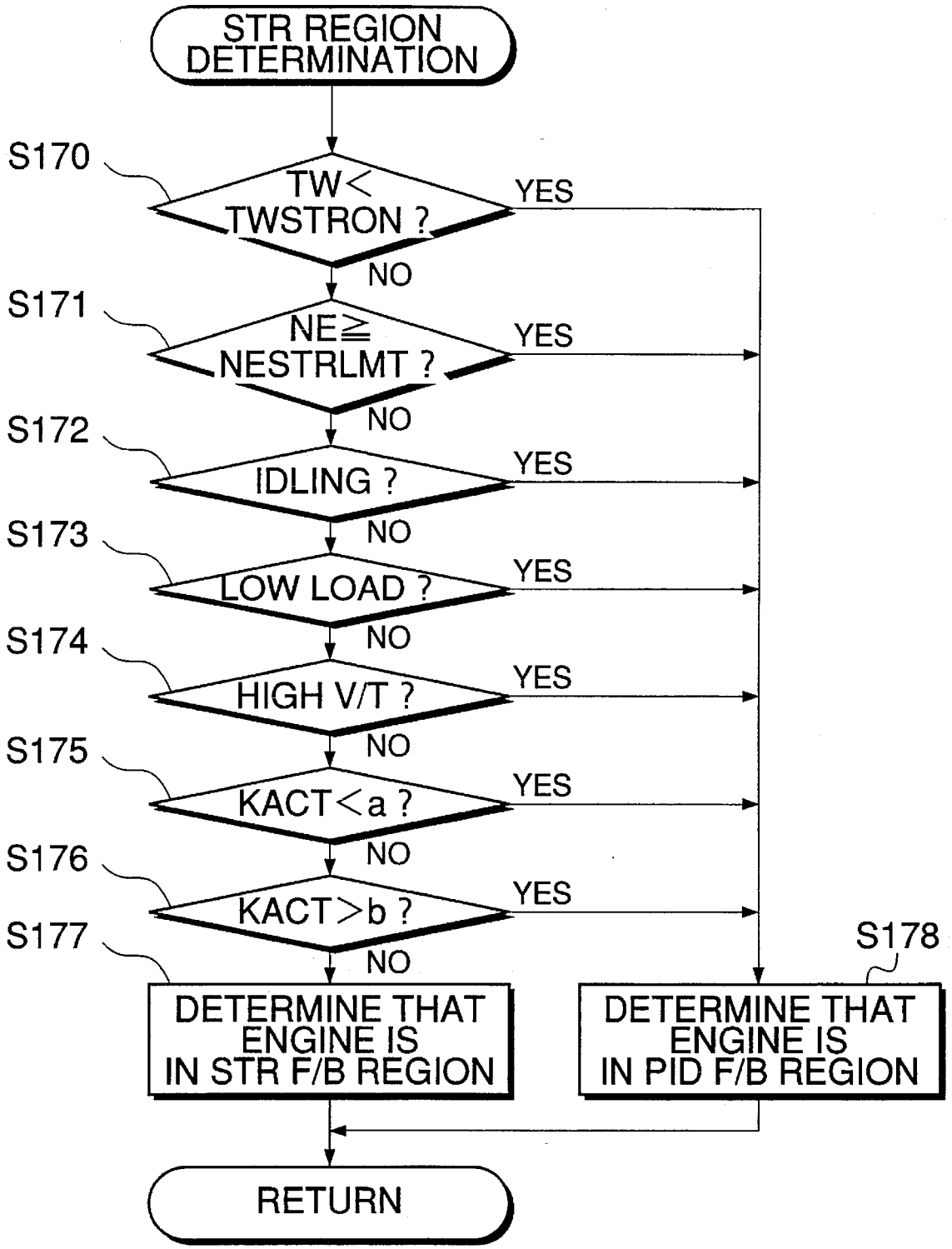
FIG. 20 is a flowchart showing a subroutine for determining an adaptive control region, which is executed at a step S156 in FIG. 19.

Then, at a step S156, a determination as to the adaptive control region should be executed is carried out, which will now be described with reference to FIG. 20 showing a subroutine for executing the determination. The subroutine of FIG. 20 determines whether the feedback correction coefficient KFB should be obtained by the adaptive control or by the PID control, based on the present operating condition of the engine.

First, it is determined at a step S170 whether or not the engine coolant temperature TW is lower than a predetermined value TWSTRON. If TW≧TWSTRON holds, it is determined at a step S171 whether or not the engine rotational speed NE is higher than a predetermined value NESTRLMT. If NE<NESTRLMT holds, it is determined at a step S172 whether or not the engine is idling. If the engine is not idling, it is determined at a step S173 whether or not the intake pipe absolute pressure PBA is lower than a predetermined value, i.e. the engine is in a low load condition. If the engine is not in a low load condition, it is determined at a step S174 whether or not the valve timing of the engine has been set to the high-speed valve timing. If the valve timing has not been set to the high-speed valve timing, it is determined at a step S175 whether or not the detected equivalent ratio KACT is smaller than a predetermined value a. If the KACT value is not smaller than the predetermined value a, it is determined at a step S176 whether or not the KACT value is larger than a predetermined value b (>a).

If any of the answers to the questions of the steps S170 to S176 is affirmative (YES), it is determined at a step S178 that the PID control should be executed, followed by terminating the present routine.

The reason why it is thus determined that the PID control should be executed and the feedback correction coefficient KFB is calculated by the PID control is as follows: When the engine coolant temperature TW is low (TW<TWSTRON), the engine combustion is not stable, so that a misfire can occur. Therefore, a stable value of the detected equivalent ratio KACT cannot be obtained if the adaptive control is carried out on such an occasion. Also when the engine coolant temperature TW is extremely high, the feedback correction coefficient KFB is calculated by the PID control for a similar reason to he above. When the engine rotational speed NE is high, i.e. if NE≧NESTRLMT holds, the ECU 5 can have an insufficient calculation time and further the engine combustion is not stable. When the high-speed valve timing is selected, an overlap time period over which the intake valves and the exhaust valves are both open is prolonged so that blowing of the mixture through the open exhaust valves without being burned within the combustion chamber can occur, and accordingly a stable value of the detected equivalent ratio KACT cannot be obtained if the adaptive control is carried out. Further, when the engine is idling, the engine operating condition is almost stable, and therefore the adaptive control, which is a high gain control, is not required.

Further, if the detected equivalent ratio KACT is smaller than the predetermined value a or larger than the predetermined value b, which means that the air-fuel ratio of the mixture supplied to the engine is lean or rich, and therefore the high-gain adaptive control should not be executed. The determinations at the steps S175 and S176 may employ the desired equivalent ratio KCMD instead of the detected equivalent ratio KACT On the other hand, if the answers to the questions of the steps S170 to S176 are all negative (NO), it is determined at a step S177 that the adaptive control should be executed, followed by terminating the present routine.

Referring again to FIG. 19, at a step S157, it is determined whether or not the feedback correction coefficient K FB should be calculated by the adaptive control, depending on the result of the determination by the FIG. 20 subroutine. If the answer to the question of the step S157 is negative (NO), the program proceeds to the step S164, whereas if the answer to the question of the step S157 is affirmative (YES), the program proceeds to a step S158, wherein it is determined whether or not the STR flag FKSTR assumed "0" in the last loop.

If FKSTR=1 held in the last loop, the program jumps to a step S161, whereas if FKSTR=0 held in the last loop, it is determined at steps S159 and S160 whether or not the detected equivalent ratio KACT falls within a range between a predetermined upper limit value KACTLMTH (e.g. 1.01) and a predetermined lower limit value KACTLMTL (e.g. 0.99). If KACT<KACTLMTL or KACT>KACTLMTH holds, the program proceeds to the step S164, wherein he PID correction coefficient KLAF is calculated. On the other hand, if KACTLMTL≦KACT≦KACTLMTH holds, the program proceeds to the step S161, wherein a KSTR calculation is executed, which will be described hereinbelow with reference to FIG. 21B showing a subroutine for calculating the adaptive correction coefficient KSTR.

By executing the steps S158 to S160, changeover of the feedback control of the engine from the PID control to the adaptive control is carried out when it is determined that the adaptive control should be executed and at the same time the detected equivalent ratio KACT assumes 1.0 or a value close thereto. Thus, smooth changeover of the feedback control from the PID control to the adaptive control can be carried out, to thereby ensure required stability of the engine control.

Figure 21B:
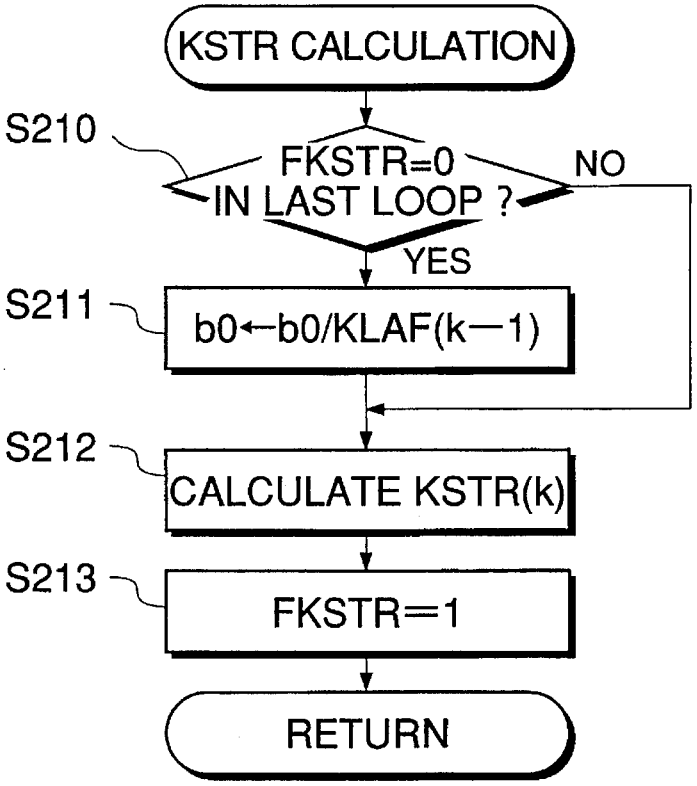
FIG. 21B is a flowchart showing a subroutine for calculating the adaptive control correction coefficient KSTR, which is executed at a step S161 in FIG. 19.

At a step S210 in FIG. 21B, it is determined whether or not the flag FKSTR assumed "0" in the last loop. If the flag KSTR assumed "1" in the last loop, the program jumps to a step S212, wherein the adaptive control correction coefficient KSTR is calculated in the manner described hereinbefore, and then the flag FKSTR is set to "1" at a step S213, followed by terminating the present routine.

On the other hand, if the flag FKSTR assumed "0" in the last loop, the adaptive parameter b0 (scalar quantity determining the gain) is replaced by a value obtained by dividing the b0 value by the last value KLAF(k−1) of the PID correction coefficient KLAF at a step S211, followed by the program proceeding to the step S212.

By replacing the adaptive parameter b0 by the value b0/KLAF(k−1) at the step S211, further smooth changeover from the PID control to the adaptive control can be obtained to thereby ensure required stability of the control. The reason for the replacement is as follows: If the value b0 in the equation (18) is replaced by the value b0/KLAF(k−1), the following equation (20) is obtained, where the first term of the first equation is equal to "1" because the adaptive correction coefficient is set to and held at 1 (KSTR(k)=1) during execution of the PID control. Accordingly, the value KSTR(k) at the start of the adaptive control becomes equal to the value KLAF(k−1), resulting in smooth changeover of the correction coefficients:

$$\begin{aligned} KSTR(k) &= \left[\frac{KCMD(k-d') - s_0 \times KACT(k) - r_1 \times KSTR(k-1) - r_2 \times KSTR(k-2) - r_3 \times KSTR(k-3)}{b_0}\right] \times KLAF(k-1) \\ &= 1 \times KLAF(k-1) \\ &= KLAF(k-1) \end{aligned} \tag{20}$$

Referring again to the FIG. 19 program, it is determined at a step S162 whether or not the absolute value of the difference between the value of the adaptive control correction coefficient KSTR obtained at the step S161 and a value of 1.0, i.e. |KSTR(k)−1.0| is larger than a reference value KSTRREF. If |KSTR(k)−1.0|>KSTRREF holds, the program proceeds to the step S164, whereas if |KSTR(k)−1.0|≦KSTRREF holds, the feedback correction coefficient FKB is set to the KSTR(k) value at a step S163, followed by terminating the present routine.

By thus determining that the PID control should be carried out when the absolute value of the difference between the adaptive control correction coefficient KSTR and 1.0 is larger than the reference value KSTRREF, required stability of the air-fuel ratio control can be ensured.

Figure 22:
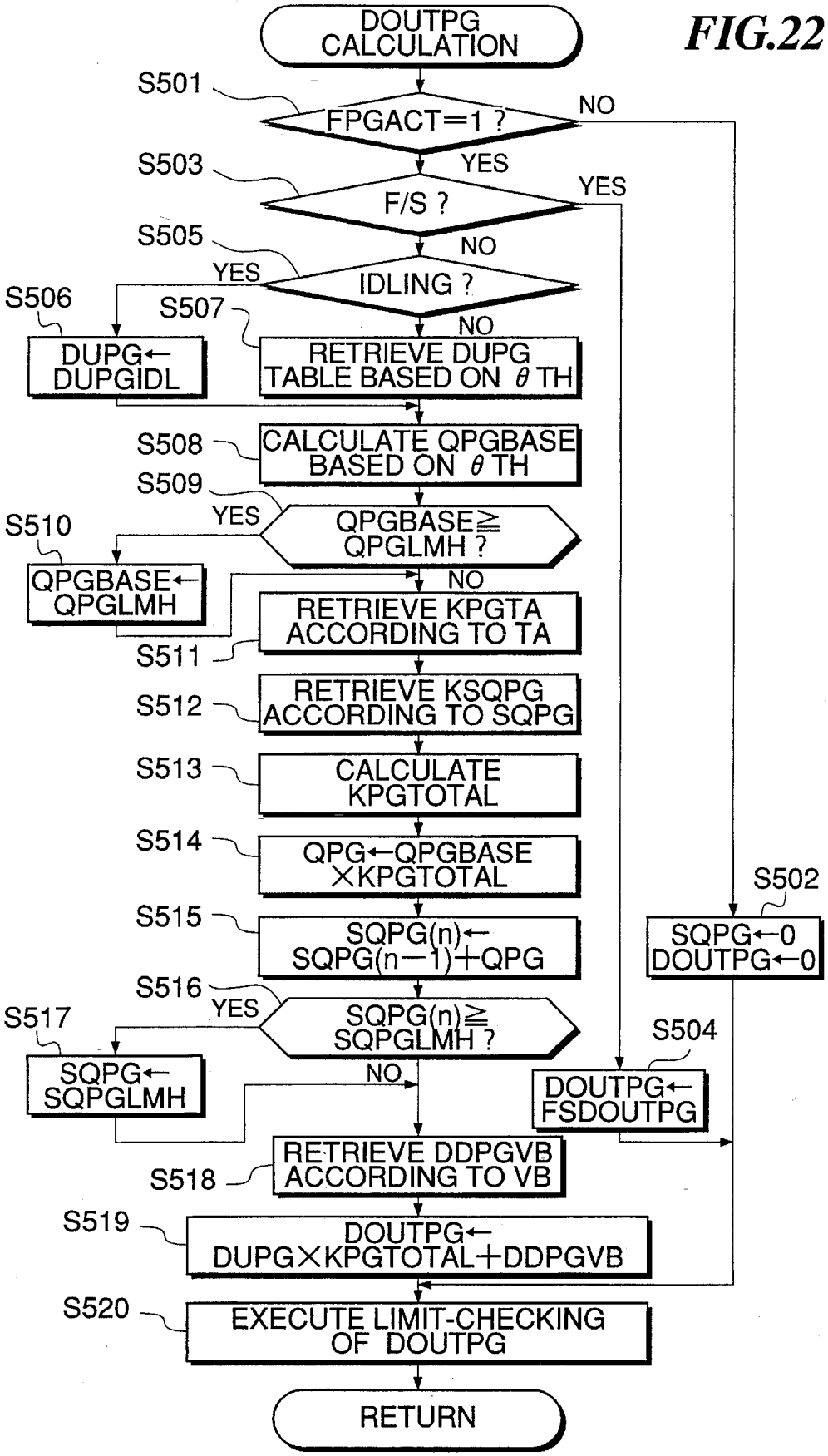
FIG. 22 is a flowchart showing a routine for calculating a valve-opening duty factor or ratio DOUTPG of a purge control valve appearing in FIG. 2.

FIG. 22 shows a routine for calculating the valve-opening duty ratio DOUTPG of the purge control valve 48. In this routine, the excessive purging correction coefficient KPGOK is set based on the set value of the excessive purging flag FPGOK, to thereby correct the valve-opening duty ratio DOUTPG.

First, at a step S501, it is determined whether or not a purging execution flag FPGACT, which, when set to "1", indicates that the purging is permitted, is set to "1". If FPGACT=0 holds, an integrated purge flow rate SQPG, referred to hereinafter, and the valve-opening duty ratio DOUTPG are both set to "0" at a step S502, and then limit-checking of the valve-opening duty ratio DOUTPG is executed at step S520, followed by terminating the present routine.

Figure 24A:
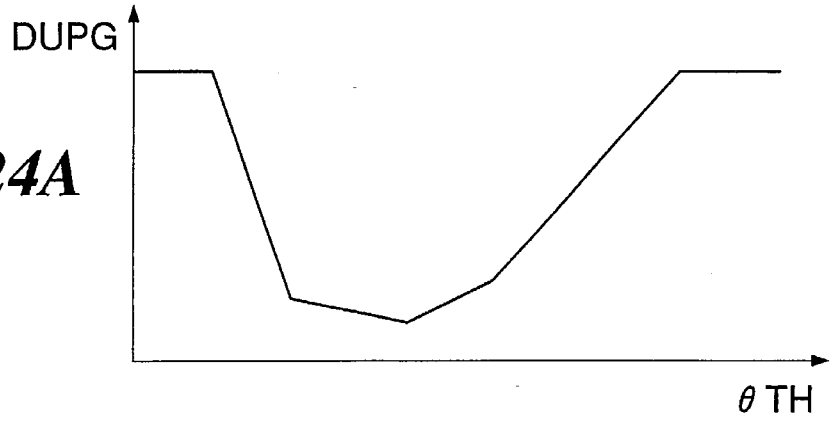
FIG. 24A shows a table for determining a basic valve-opening duty ratio DUPG.

If FPGACT=1 holds at the step S501, it is determined at a step S503 whether or not abnormality of the evaporative emission control system has been detected. If abnormality has been detected, the valve-opening duty ratio DOUTPG is set to a predetermined value FSDOUTPG for fail-safe action at a step S504, followed by the program proceeding to the step S520. On the other hand, if abnormality has not been detected, it is determined at a step S505 whether or not the engine is idling. If the engine is idling, a basic valve-opening duty ratio DUPG is set to a predetermined value DUPGIDL for idling at a step S506. On the other hand, if the engine is not idling, a DUPG table which is set according to the throttle valve opening θTH, as shown in FIG. 24A, is retrieved to determine the basic valve-opening duty ratio DUPG at a step S507.

At the following step S508, a basic purge flow rate QPGBASE is calculated according to the throttle valve opening θTH, by the use of the following equation (21)

$$QPGBASE=KQPG\times(\theta TH-\theta THIDL)+CQPG \quad (21)$$

where KQPG represents a constant, CQPG a purge flow rate assumed during idling, and θTHIDL a throttle valve opening assumed during idling.

Figure 24B:
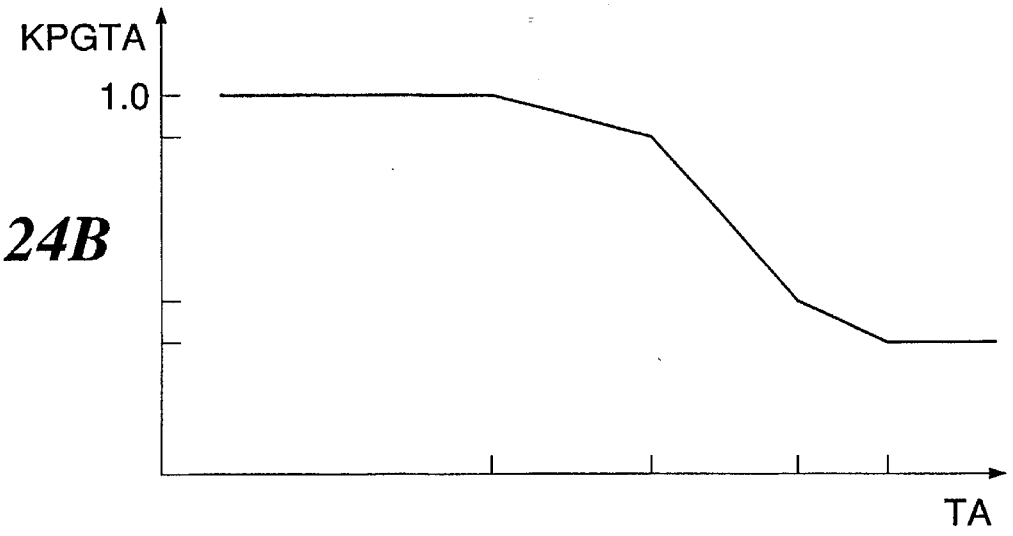
FIG. 24B shows a table for determining an intake air temperature-dependent purge correction coefficient KPGTA.
Figure 24C:
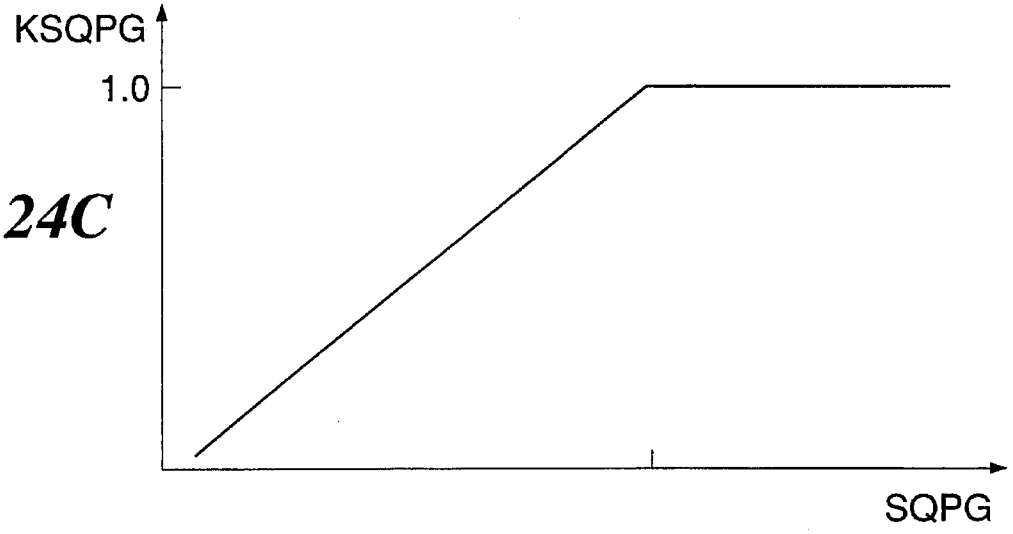
FIG. 24C shows a table for determining an integrated purge flow rate-dependent correction coefficient KSQPG.

Next, it is determined at a step S509 whether or not the calculated basic purge flow rate QPGBASE is larger than a predetermined upper limit value QPGLMH. If QPGBASE<QPGLMH holds, the program immediately proceeds to a step S511. On the other hand, if QPGBASE≧QPGLMH holds, the value QPGBASE is set to the predetermined upper limit value QPGLMH at a step S510, followed by the program proceeding to the step S511. At the step S511, a KPGTA table which is set according to the intake air temperature TA, as shown in FIG. 24B, is retrieved to determine an intake temperature-dependent purging correction coefficient KPGTA. Then, at a step S512, a KSQPG table which is set according to the integrated purge flow rate SQPG, as shown in FIG. 24C, is retrieved to determine an integrated purge flow rate-dependent correction coefficient KSQPG.

Figure 23:
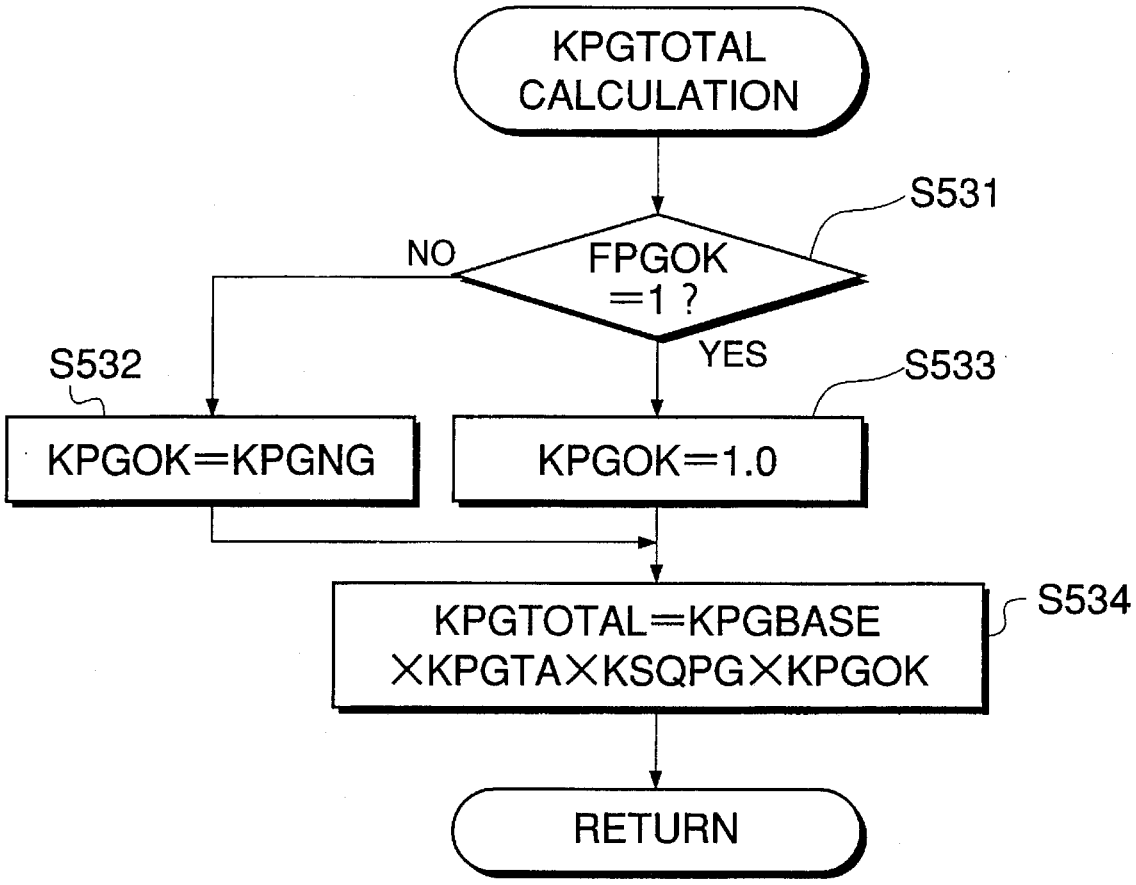
FIG. 23 is a flowchart showing a subroutine for calculating a total purge correction coefficient KPGTOTAL, which is executed at a step S513 in FIG. 22.

At the following step S513, a total purging correction coefficient KPGTOTAL is calculated by a calculation subroutine shown in FIG. 23.

At a step S531 in FIG. 23, it is determined whether or not the excessive purging flag FPGOK has been set to "1" (see FIGS. 16 and 18). If FPGOK=1 holds, i.e. if the engine is not in the excessive purging state, the excessive purge correction coefficient KPGKO is set to 1.0 at a step S533. On the other hand, if FPGOK=0 holds, i.e. if the engine is in the excessive purging state, the excessive purging correction coefficient KPGOK is set to the predetermined value KPGNG (e.g. 0.5 to 0.8) at a step S532. Then, at a step S534 the total purging correction coefficient KPGTOTAL is calculated by the use of the following equation (22), followed by terminating the program:

$$KPGTOTAL=KPGBASE\times KPGTA\times KSQPG\times KPGOK \quad (22)$$

where KPGBASE represents a basic adjusting coefficient.

Referring again to the FIG. 22 routine, at a step S514, the purge flow rate QPG is calculated by the use of the following equation (23):

$$QPG=QPGBASE\times KPGTOTAL \quad (23)$$

Then, at a step S515, the integrated purge flow rate SQPG is calculated by adding the value QPG calculated at the step S514 to the last value of the integrated purge flow rate SQPG(n−1), by the use of the following equation (24):

$$SQPG(n)=SQPG(n-1)+QPG \quad (24)$$

At the following step S516, it is determined whether or not the integrated purge flow rate SQPG is higher than a predetermined upper limit value SQPGLMH. If SQPG<SQPGLMH holds, the program proceeds to a step S518. On the other hand, if SQPG≧SQPGLMH holds, the value SQPG is set to the predetermined upper limit value SQPGLMH, followed by the program proceeding to the step S518. At the step S518, a correction amount DDPGVB corresponding to an ineffective time period of the fuel injection valve 12 is retrieved from a table, not shown, according to the battery voltage VB, and then at a step S519, the valve opening duty ratio DOUTPG is calculated by the use of the following equation (25):

$$DOUTPG=DUPG\times KPGTOTAL+DDPGVB \quad (25)$$

At the following step S520, the thus calculated valve opening duty ratio DOUTPG is subjected to limit-checking, followed by terminating the program.

More specifically, the DOUTPG value is limited to a range between a lower limit value of "0" and a predetermined upper limit value.

As described above, according to the present embodiment, an excessive purging state is determined by executing the processing of FIG. 16 or FIG. 18, i.e. from the average value KLAFPGVAE of the PID correction coefficient KLAF obtained during purging, or the average value KSTRPGAVE of the adaptive control correction coefficient KSTR obtained during purging, to thereby set the excessive purging flag FPGOK. Further, by executing the processings of FIGS. 22 and 23, when the excessive purging state is determined, the excessive purging correction coefficient KPGOK is set to the predetermined value KPGNG smaller than 1.0 (see the steps S531 and S532), whereby the valve opening duty ratio DOUTPG of the purge control valve is corrected in the direction of decreasing the duty ratio. As a result, the excessive purging state can be promptly eliminated, to thereby maintain excellent control accuracy of the air-fuel ratio control even during purging.

Figure 25:
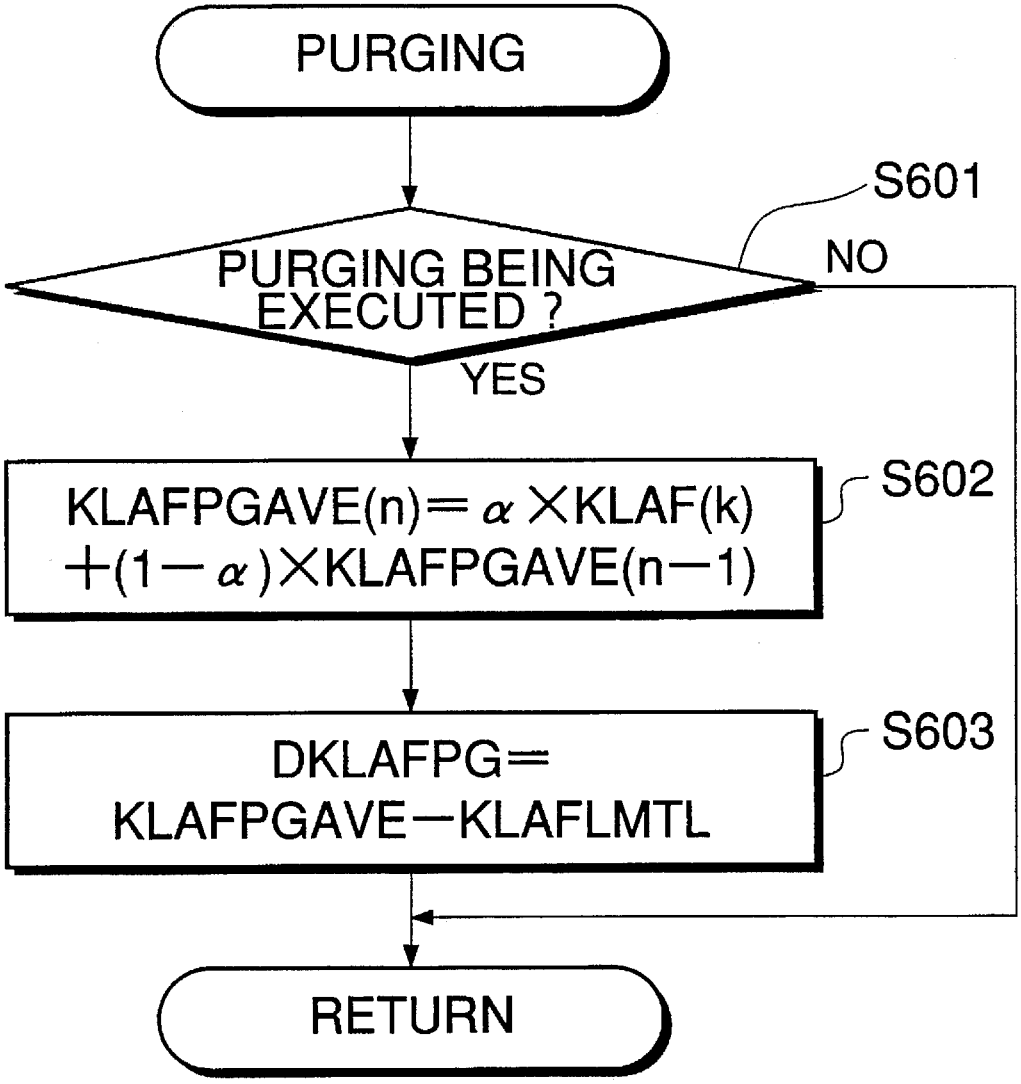
FIG. 25 is a flowchart showing a subroutine for purging evaporative fuel, which is executed at a step S313 in FIG. 15, according to a second embodiment of the invention.
Figure 26:
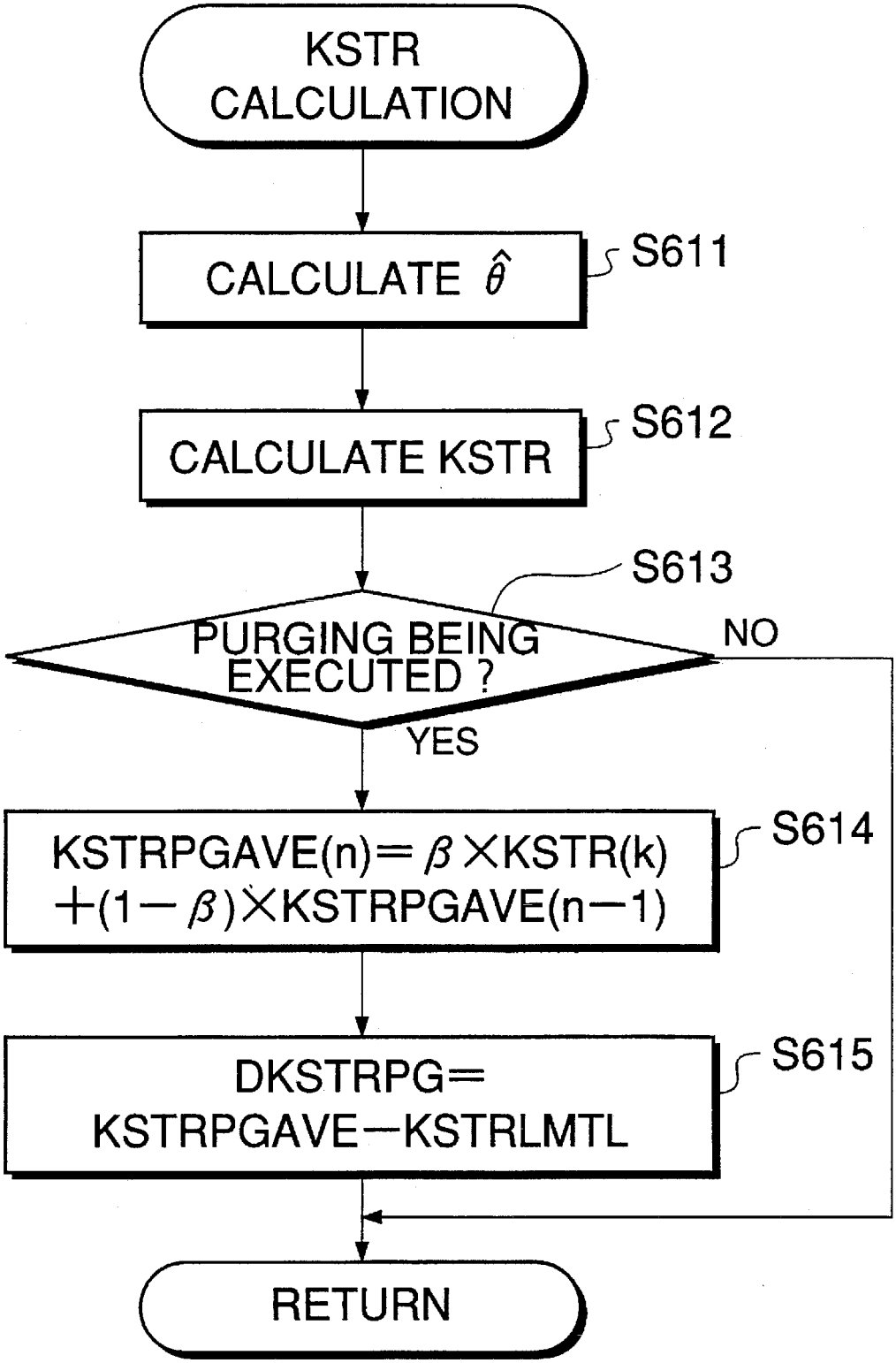
FIG. 26 is a flowchart showing a subroutine for calculating the KSTR value, which is executed at the step S9 in FIG. 4.
Figure 27:
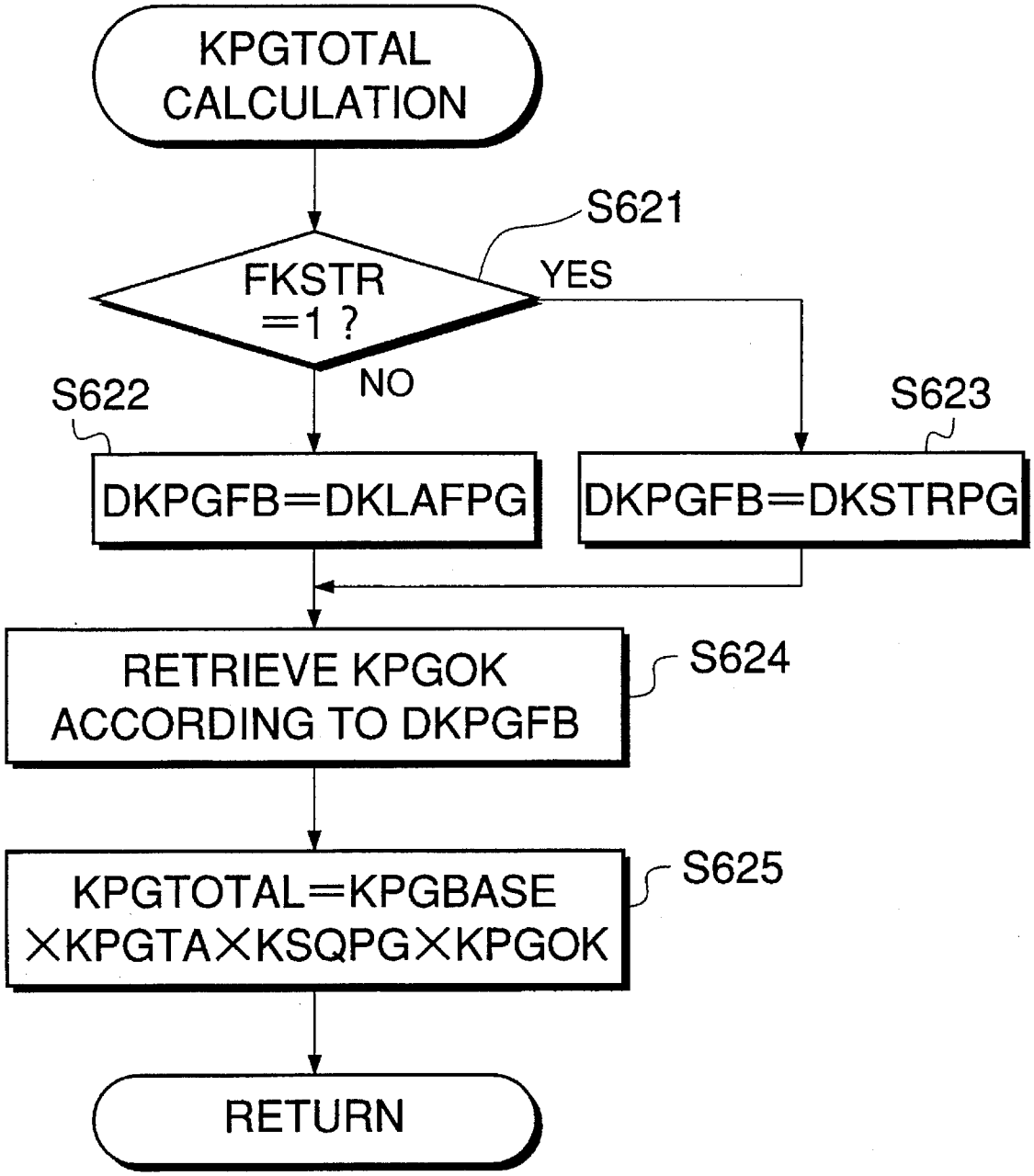
FIG. 27 is a flowchart showing a subroutine for calculating the KPGTOTAL value, which is executed at the step S513 in FIG. 22.

Next, description will be made of a second embodiment of the invention. According to the present embodiment, in place of the purging processing of FIG. 16, the KSTR calculation of FIG. 18, and the KPGTOTAL calculation of FIG. 23, processings of FIGS. 25, 26 and 27 are employed, respectively. Except for these, the present embodiment is identical with the first embodiment described above.

FIG. 25 shows a subroutine for executing purging, which corresponds to the FIG. 16 subroutine of the first embodiment. Steps S601 and S602 are identical with the steps S331 and S332 in FIG. 16.

At a step S603, a difference DKLAFPG (=KLAFPGAVE–KLAFLMTL) between the average value KLAFPGAVE of the PID correction coefficient KLAF during purging and a predetermined lower limit value KLAFLMTL is calculated, followed by terminating the present routine.

FIG. 26 shows a subroutine for calculating the adaptive control correction coefficient KSTR, which corresponds to the FIG. 18 subroutine of the first embodiment. Steps S611 to S614 are identical with the steps S401 to S404.

At a step S615, a difference DKSTRPG (=KSTRPGAVE–KSTRLMTL) between the average value KSTRPGAVE of the adaptive control correction coefficient KSTR during purging and a predetermined lower limit value KSTRLMTL is calculated, followed by terminating the present routine.

FIG. 27 shows a subroutine for calculating the total purging correction coefficient KPGTOTAL, which corresponds to the FIG. 23 subroutine of the first embodiment. First, it is determined at a step S621 whether or not the STR flag FKSTR has been set to "1". If FKSTR=0 holds, which means that the air-fuel ratio is being controlled by the PID control, a correction variable DKPGFB is set to the difference DKLAFPG calculated at the step S603 in FIG. 25, at a step S622. On the other hand, if FKSTR=1 holds, which means that the air-fuel ratio is being controlled by the adaptive control, the correction variable DKPGFB is set to the difference DKSTRPG calculated at the step S615 in FIG. 26, at a step S623.

Figure 28A:
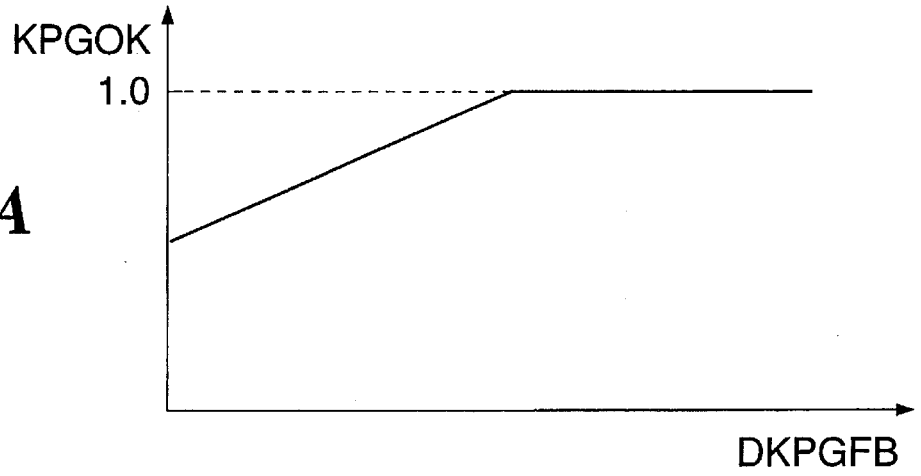
FIG. 28A shows a table for determining an excessive purging correction coefficient KPGOK employed in the FIG. 27 subroutine.

At the following step S624, a table which is set according to the correction variable DKPGFB, as shown in FIG. 28A, is retrieved to determine the excessive purging correction coefficient KPGOK. Then, at a step S625, the total purging correction coefficient KPGTOTAL is calculated by the use of the above given equation (22), followed by terminating the present program.

According to the present embodiment, as the correction variable DKPGFB is smaller, i.e. as the difference DKLAFPG or DKSTRPG is closer to the lower limit value KLAFLMTL or KSTRLMTL, in other words as the purged fuel amount increases, the value KPGOK is set to a smaller value. Therefore, the purging amount control can be carried out so as to set a suitable purging amount depending on the degree of the influence of the purged fuel amount. As a result, good controllability of the air-fuel ratio control can be maintained even during purging.

Next, description will be made of a third embodiment of the invention. According to the present embodiment, the difference DKLAFPG and the difference DKSTRPG employed in the subroutines of FIGS. 25 and 26 in the second embodiment are calculated by the following equations (26) and (27):

$$DKLAFPG=1.0-KLAFPGAVE \quad (26)$$

$$DKSTRPG=1.0-KSTRPGAVE \quad (27)$$

Figure 28B:
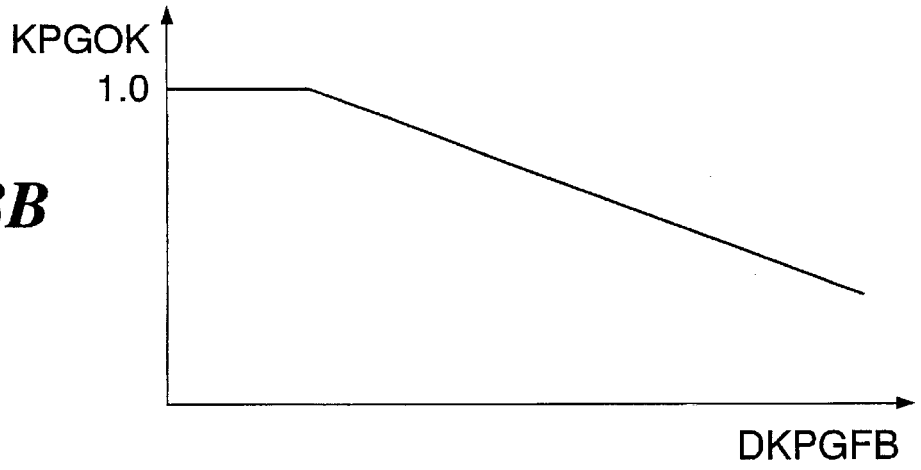
FIG. 28B shows a table for determining the KPGOK value according to a third embodiment of the invention.

Further, a table shown in FIG. 28B is employed for determining the excessive purging correction coefficient KPGOK, in place of the FIG. 28A table. Except for this, the present embodiment is identical with the second embodiment.

According to the present embodiment, the differences DKLAFPG and DKSTRPG are increased according to an increase in the purged fuel amount. As a result, by employing the table shown in FIG. 28B, the same effect as in the second embodiment can be achieved.

In the above described embodiments, alternatively only one of the average value of the PID correction coefficient KLAF and the average value of the adaptive control correction coefficient KSTR may be calculated during purging to correct the valve-opening duty ratio DOUTPG of the purge control valve.

What is claimed is:

1. A control system for an internal combustion engine having an intake system, an exhaust system, and a fuel tank, comprising:

a canister for adsorbing evaporative fuel generated in said fuel tank;

a purging passage extending between said canister and said intake system, for purging said evaporative fuel into said intake system;

a purge control valve for controlling a flow rate of said evaporative fuel to be supplied to said intake system through said purging passage;

operating condition-detecting means for detecting operating conditions of said engine;

purge flow rate control means for controlling said purge control valve according to operating conditions detected by'said operating condition-detecting means;

an air-fuel ratio sensor arranged in said exhaust system;

feedback control means for carrying out feedback control of an amount of fuel to be supplied to said engine by calculating a feedback control amount based on an output from said air-fuel ratio sensor by using a controller of a recurrence formula type, and controlling said amount of fuel to be supplied to said engine, based on the calculated feedback control amount, such that an air-fuel ratio of an air-fuel mixture supplied to said engine is converged to a desired air-fuel ratio; and control amount-averaging means for calculating an average value of said feedback control amount while said purge control valve is open;

wherein said purge flow rate control means controls said purge control valve, based on said average value calculated by said control amount-averaging means.

2. A control system as claimed in claim 1, wherein said feedback control means calculates a basic fuel amount according to operating conditions of said engine detected by said operating condition detecting means and calculates an adaptive correction coefficient by using said controller of said recurrence formula type, based on said output from said air-fuel ratio sensor, to thereby determine an amount of fuel to be supplied to said engine, based on said basic fuel amount and said adaptive correction coefficient, said control amount-averaging means calculating an average value of said adaptive correction coefficient as said average value of said feedback control amount while said purge control valve is open.

3. A control system as claimed in claim 1, wherein said purge flow rate control means includes comparing means for comparing said average value of said feedback control amount with a predetermined value, said purge flow rate control means controlling said purge control valve, based on a result of the comparison by said comparing means.

4. A control system as claimed in claim 3, wherein said purge flow rate control means calculates a valve-opening amount of said purge control valve, based on a basic valve opening amount depending on operating conditions of said engine detected by said operating condition-detecting means, and a correction coefficient determined depending on operating conditions of said engine detected by said operating condition-detecting means and a flow rate of evaporative fuel purged through said purging passage, said purge flow rate control means changing said correction coefficient, based on said result of the comparison of said comparing means.

5. A control system as claimed in claim 1, wherein said purge flow rate control means includes difference-calculating means for calculating a difference between said average value of said feedback control amount and a predetermined reference value, said purge flow rate control means controlling said purge control valve, based on said difference.

6. A control system as claimed in claim 5, wherein said purge flow rate control means calculates a valve-opening amount of said purge control valve, based on a basic valve opening amount depending on operating conditions of said engine detected by said operating condition-detecting means, and a correction coefficient determined depending on said detected operating conditions of said engine detected by said operating condition-detecting means and a flow rate of evaporative fuel purged through said purging passage, said purge flow rate control means changing said correction coefficient, based on said difference calculated by said difference-calculating means.

* * * * *